US006810620B1

(12) United States Patent
Anderson et al.

(10) Patent No.: US 6,810,620 B1
(45) Date of Patent: Nov. 2, 2004

(54) ADJUSTABLE HEIGHT SHUTTER

(75) Inventors: Richard N. Anderson, Whitesville, KY (US); Donald E. Fraser, Owensboro, KY (US)

(73) Assignee: Hunter Douglas Inc, Upper Saddle River, NJ (US)

( * ) Notice: Subject to any disclaimer, the term of this patent is extended or adjusted under 35 U.S.C. 154(b) by 0 days.

(21) Appl. No.: 10/305,491

(22) Filed: Nov. 27, 2002

Related U.S. Application Data

(60) Provisional application No. 60/337,071, filed on Dec. 4, 2001.

(51) Int. Cl.[7] ..... E06B 7/08

(52) U.S. Cl. ..... 49/74.1; 49/89.1; 49/90.1; 49/403

(58) Field of Search ..... 49/74.1, 89.1, 49/403, 90.1

(56) References Cited

U.S. PATENT DOCUMENTS

| | | | | | |
|---|---|---|---|---|---|
| 247,349 | A | | 9/1881 | Hill | |
| 1,701,695 | A | * | 2/1929 | Paine | 49/74.1 |
| 2,902,728 | A | * | 9/1959 | Nardulli | 49/64 |
| 3,108,246 | A | * | 10/1963 | Jones | 340/852 |
| 3,932,959 | A | * | 1/1976 | Jansons et al. | 49/74.1 |
| 4,251,966 | A | | 2/1981 | Foltman | |
| 4,294,283 | A | * | 10/1981 | Scharres | 137/599.02 |
| 4,936,048 | A | | 6/1990 | Ruggles | |
| 5,469,658 | A | | 11/1995 | Digianni et al. | |
| 5,548,925 | A | | 8/1996 | Marocco | |
| 5,595,231 | A | | 1/1997 | Marocco | |
| 5,778,598 | A | | 7/1998 | Obanesian | |
| 5,921,028 | A | | 7/1999 | Marocco | |
| 6,041,547 | A | | 3/2000 | Marocco | |
| 6,219,985 | B1 | * | 4/2001 | Hsu | 52/473 |
| 6,266,923 | B1 | * | 7/2001 | Lee | 49/87.1 |

FOREIGN PATENT DOCUMENTS

AU B3-37879/00 8/2000

OTHER PUBLICATIONS

U.S. patent application 10/214,835; filed Aug. 8, 2002; Applicant Norbert Marocco.

* cited by examiner

*Primary Examiner*—Jerry Redman
(74) *Attorney, Agent, or Firm*—Camoriano and Associates; Theresa Fritz Camoriano; Guillermo Camoriano

(57) ABSTRACT

A shutter design is provided that permits easy, economical adjustments in height. This may be achieved by providing varying heights of rails, by providing adjustable light stop strips, by adjusting the pitch of the louvers, or by a combination of two or more of these methods.

20 Claims, 24 Drawing Sheets

216
220
300
304

226
228
230
306
302

ADJUSTABLE HEIGHT SHUTTER

This application claims priority from U.S. Provisional Application Ser. No. 60/337,071 filed Dec. 4, 2001.

BACKGROUND OF THE INVENTION

Shutters are designed to cover architectural openings, such windows. Since these openings may come in all different sizes, it is desirable to supply shutters which can accommodate varying opening sizes. The present invention addresses the issue of supplying shutters which are readily adjustable to fit into openings of varying heights.

SUMMARY OF THE INVENTION

A primary objective of the present invention is to provide an improved shutter design, wherein the components allow easy customization of the height of the shutter in an economical, efficient manner.

DESCRIPTION OF THE PREFERRED EMBODIMENTS

Figure 2:
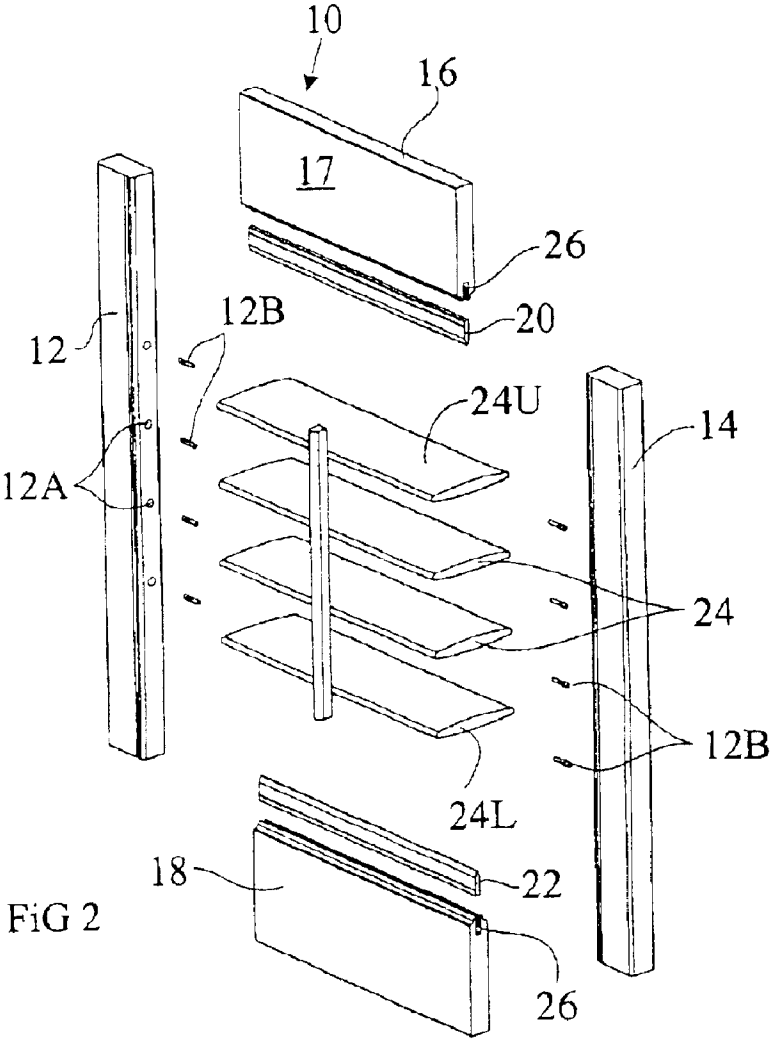
FIG. 2 is an exploded perspective view of the shutter of FIG. 1.
Figure 1:
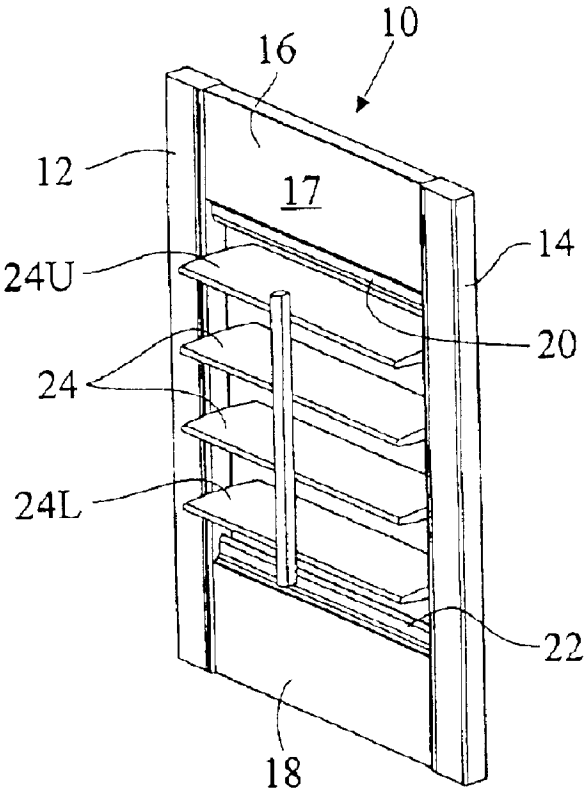
FIG. 1 is a perspective view of a first embodiment of a shutter made in accordance with the present invention, including an adjustable light stop strip.

FIGS. 1 and 2 show a first embodiment of a shutter 10 made in accordance with the present invention. The shutter 10 includes left and right vertical stiles 12, 14 and upper and lower horizontal cross rails 16, 18, which are secured together to form a substantially rectangular frame. Upper and lower adjustable light stop strip strips 20, 22 are mounted on the upper and lower cross rails 16, 18, as will be described later. A plurality of louvers 24 is pivotably mounted to the stiles 12, 14, including an uppermost louver 24U and a lowermost louver 24L. The pivot points are defined by holes 12A in the stiles 12, 14 and by pins 12B, which extend into the holes 12A and into the ends of their respective louvers 24. The pins 12B serve as projections which mount the louvers to the stiles. If end caps (not shown) are used on the louvers 24, the end caps may include integral pins or projections. The substantially rectangular frame formed by the stiles 12, 14 and cross rails 16, 18 has an inner perimeter, and the louvers 24 are located within that inner perimeter. The light stop strips 20, 22 project vertically inwardly from the inner perimeter and are recessed from the front face 17 or rear face 19 of their respective cross rails, so that the outermost louvers 24U and 24L can close in a generally vertical direction abutting against the light stop strip.

This shutter 10 is generally used to cover architectural openings, such as windows, and these openings may come in a variety of sizes. Since the size of openings may vary, it is desirable to have the ability to modify the size of the shutter to fit the opening. Altering pre-finished components of a shutter to fit into a particular width is not generally a problem. The cross rails 16, 18 may be cut to extend across the desired width of the opening, and these cut ends are covered by the vertical stiles, so they do not show. Likewise, the louvers 24 may also be cut to the desired length, and end caps (not shown) may be placed over the ends of the louvers 24 to finish off the cut ends and to provide a mechanism to pivotably mount the louvers 24 to the stiles 12, 14. However, cutting the pre-finished components of a shutter to adjust the height would pose a problem. While the stiles 12, 14 readily can be cut to the desired height, cutting the upper or lower edges of the cross rails 16,18 would leave an unfinished cut edge which would then have to be refinished. This shutter 10 has features that permit height adjustment without requiring cutting of the cross rails 16, 18.

In this embodiment, one such feature is the adjustable upper and lower light stop strip strips 20, 22. In addition, the assembler may be provided with cross rails 16, 18 of various heights. FIGS. 10A through 18D show how a combination of adjustable light stop strips and varying heights of cross rails 16, 18 can be used to span a wide range of opening heights.

Figure 6A:
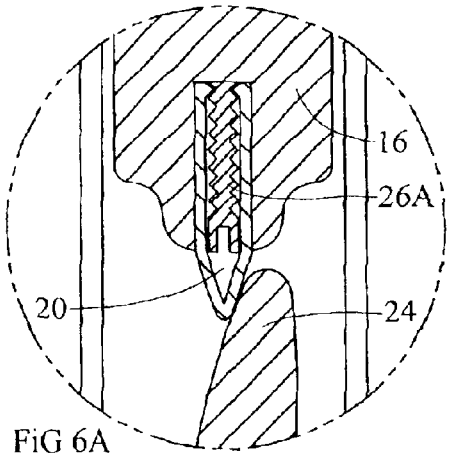
FIG. 6A is detailed, enlarged section view of a first type of adjustable light stop strip that can be used in the shutter of FIG. 1, with the light stop strip shown in the fully retracted position.
Figure 6B:
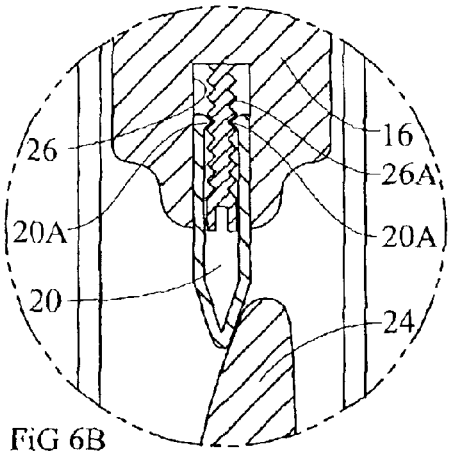
FIG. 6B is identical to FIG. 6A, except it depicts the light stop strip in a medium extended position.
Figure 6C:
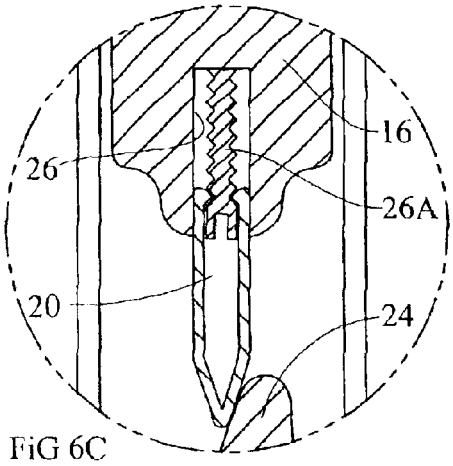
FIG. 6C is identical to FIG. 6A, except it depicts the light stop strip in a maximum extended position.

FIGS. 6A–C show a first type of adjustable light stop strip 20. In this embodiment, there is a groove 26 extending along the inner surface of the rail 16, and a plurality of evenly-spaced toothed studs 26A are anchored at one end in the rail 16 and project downwardly into the central portion of the groove 26. The light stop strip 20 is hollow and has barbs (or teeth) 20A on its inner surface, which mate with the teeth in the studs 26A. The light stop strip 20 can be pushed into the groove 26 or pulled out of the groove 26 to the desired position, with the barbs 20A catching in a space between the teeth on the studs 26A to secure the light stop strip 20 at the desired position. In FIG. 6A, the light stop strip 20 is fully retracted. In FIG. 6B, the light stop strip is at an intermediate position. In FIG. 6C, the light stop strip 20 is in its extended position. It should be noted that the gap between the end of the louver 24 and the cross rail 16 is small when the light stop strip 20 is retracted and large when the light stop strip 20 is extended. The ability to adjust the distance between the outermost louvers 24U, 24L and their respective cross rails 16, 18 provides a way to adjust the height of the shutter without cutting the upper and lower cross rails 16, 18.

Figure 7A:
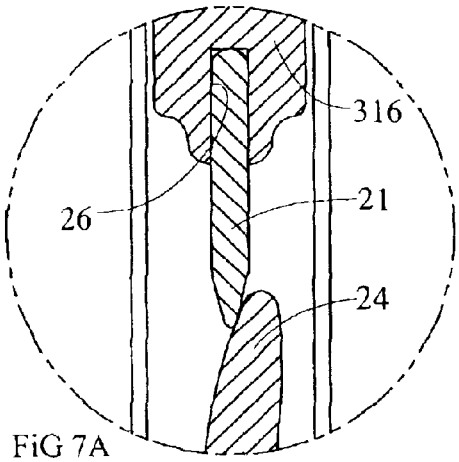
FIG. 7A is detailed, enlarged section view of another type of adjustable light stop strip that can be used in the shutter of FIG. 1, with the light stop strip in the fully retracted position.
Figure 7B:
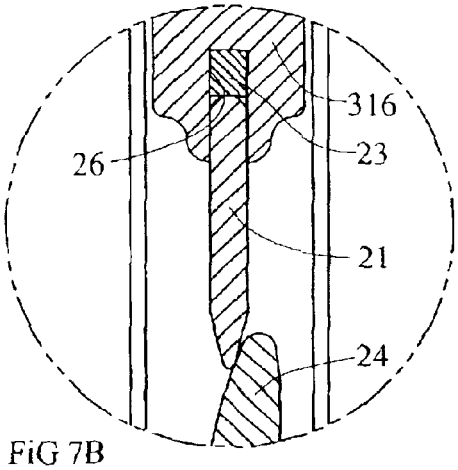
FIG. 7B is identical to FIG. 7A, except it depicts the light stop strip in a medium extended position.
Figure 7C:
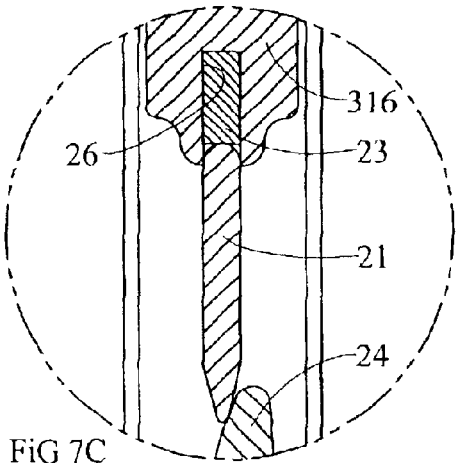
FIG. 7C is identical to FIG. 7A, except it depicts the light stop strip in a maximum extended position.

FIGS. 7A through 7C show an alternate light stop strip 21, which is similar to the light stop strip 20 described earlier, except it does not have the mating barbs and teeth or the central studs 20A. Instead, in order to keep the light stop strip 21 in its desired position, a shim 23 (See FIGS. 7B and 7C) is inserted in the groove 26, and there is a snug fit between the light stop strip 21 and its respective groove 26. The shim 23 prevents the light stop strip 21 from being pushed further into the groove 26 than is desired. The height of the shim 23 determines how far the light stop strip 21 projects from the cross rail 16, and various heights of shims may be provided to the assembler. As with other embodiments of adjustable light stop strips, once this light stop strip 21 is in the desired position, it may be secured to the cross rail 16 by some means such as adhesive or staples. If the light stop strip is to be secured, a shim may not be needed. FIG. 7A shows the light stop strip 21 fully retracted, FIG. 7B shows it at an intermediate extension, and FIG. 7C shows the light stop strip 21 fully extended.

FIGS. 8, 8A–C, and 9 show another embodiment of an adjustable light stop strip 220. The light stop strip 220 has a bullet-shaped cross-sectional profile, with a tapered nose 228, which projects out of the groove 226 of the cross rail 216. The other end 230 of the light stop strip 220 has a rectangular-shaped profile, which is received in the similarly-shaped groove 226 of the cross rail 216. The light stop strip 220 has small barbs or teeth 232 in its outer surface, which mesh with corresponding small barbs or teeth 234 on the inside surface of the groove 226 to provide a stepwise adjustment between the light stop strip 220 and the cross rail 216 or 218. Once the light stop strip 220 is properly placed in the groove at the desired location, the meshing of the barbs or teeth 232, 234 prevents accidental vertical movement of the light stop strip 220 relative to the cross rail 216. The light stop strip 220 may be shifted in vertical position relative to the cross rail 216 simply by pulling or pushing on the light stop strip 220. If this relocation is undesirable, once the light stop strip 220 is in the proper position, the cross rail 216 and its respective light stop strip 220 may be secured together in the desired position (with an adhesive or staples, for instance). Of course, the lower light stop strip 222 may be mounted in the lower cross rail 218 in the same manner.

Figure 9:
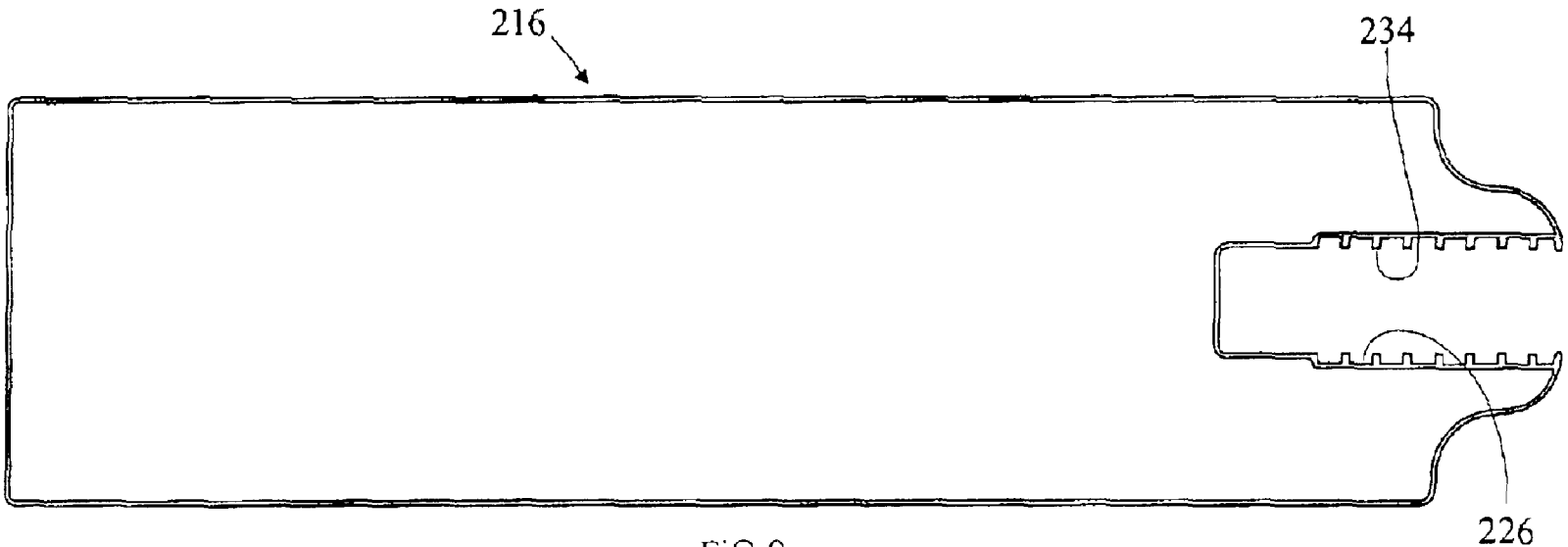
FIG. 9 is an enlarged end view of the cross rail of FIGS. 8A–C.
Figure 8A:
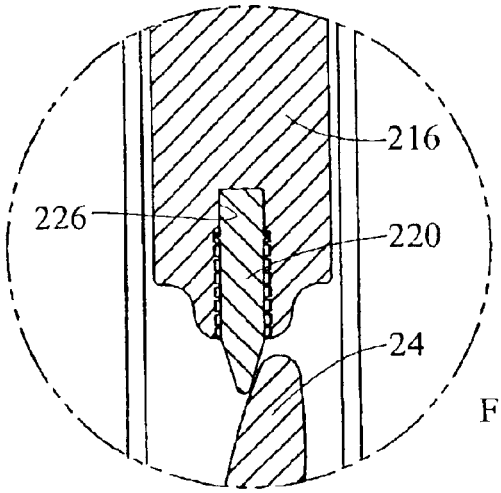
FIG. 8A is a detailed, enlarged section view of the light stop strip of FIG. 8 installed in the shutter and in a retracted position.
Figure 8B:
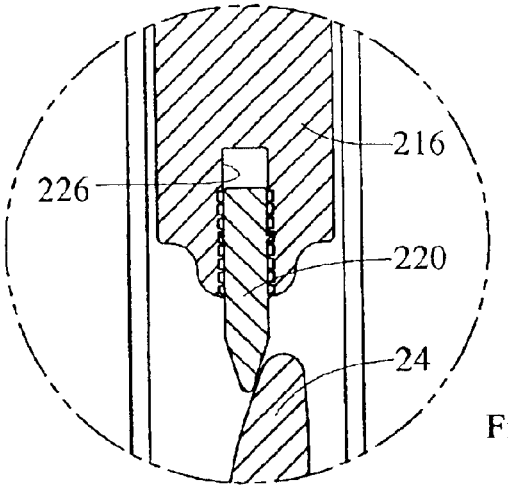
FIG. 8B is the same view as FIG. 8A but with the light stop strip in an intermediate position.
Figure 8C:
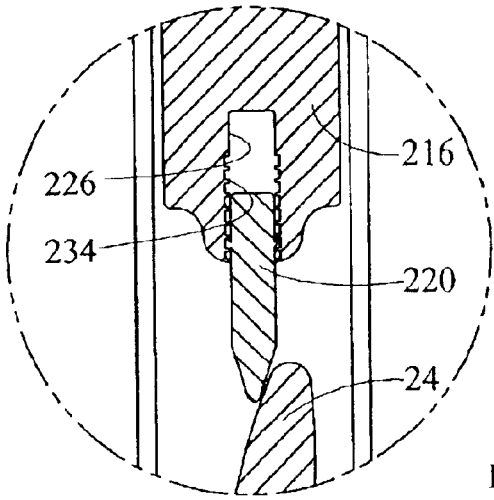
FIG. 8C is the same view as FIG. 8A but in a more fully extended position.
Figure 9A:
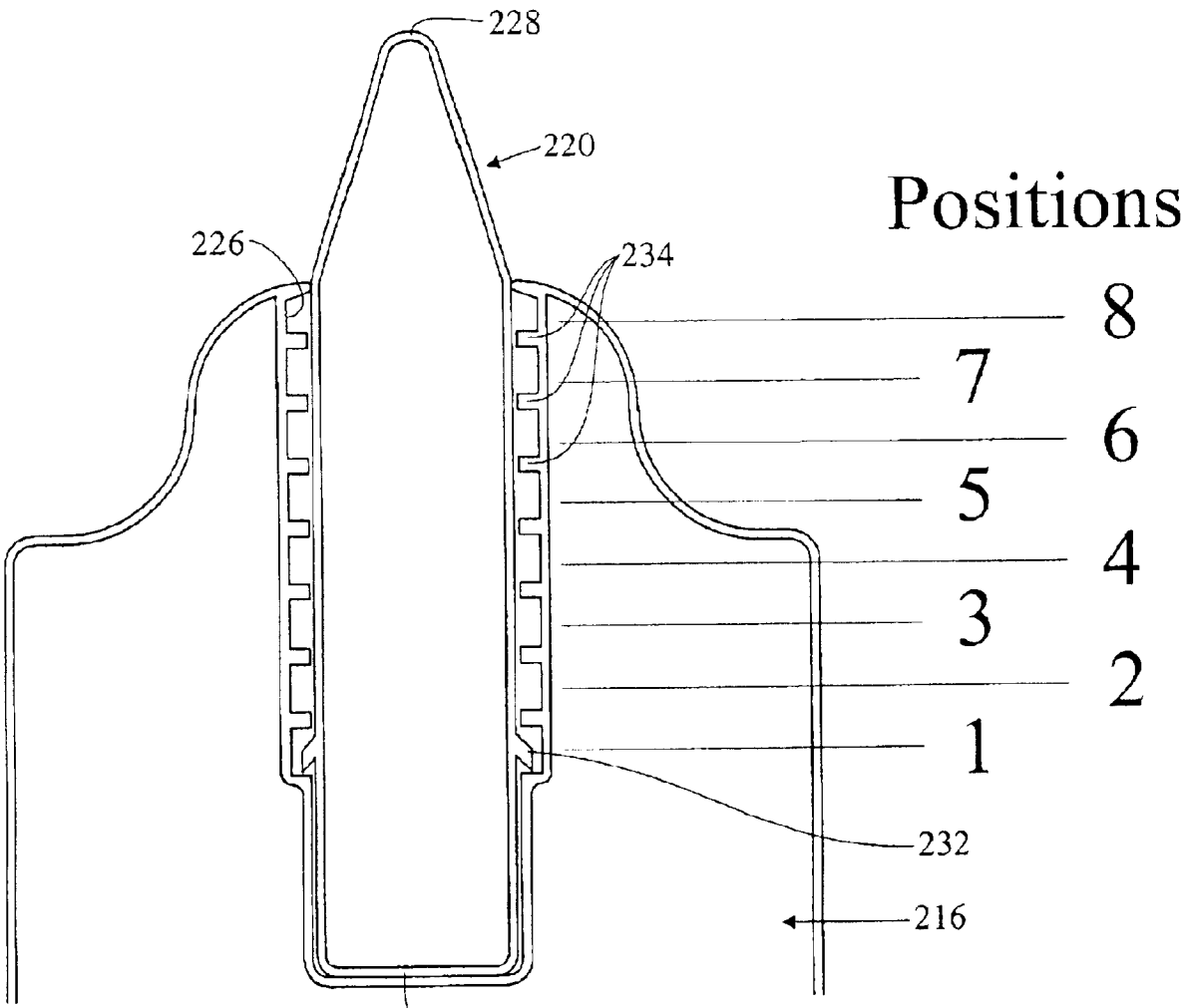
FIG. 9A is a cut away, sectional view of the cross rail of FIG. 9 and the light stop strip of FIG. 8.
Figures 9B, 9C, 9D, 9E, 9F, 9G, 9H, 9I:
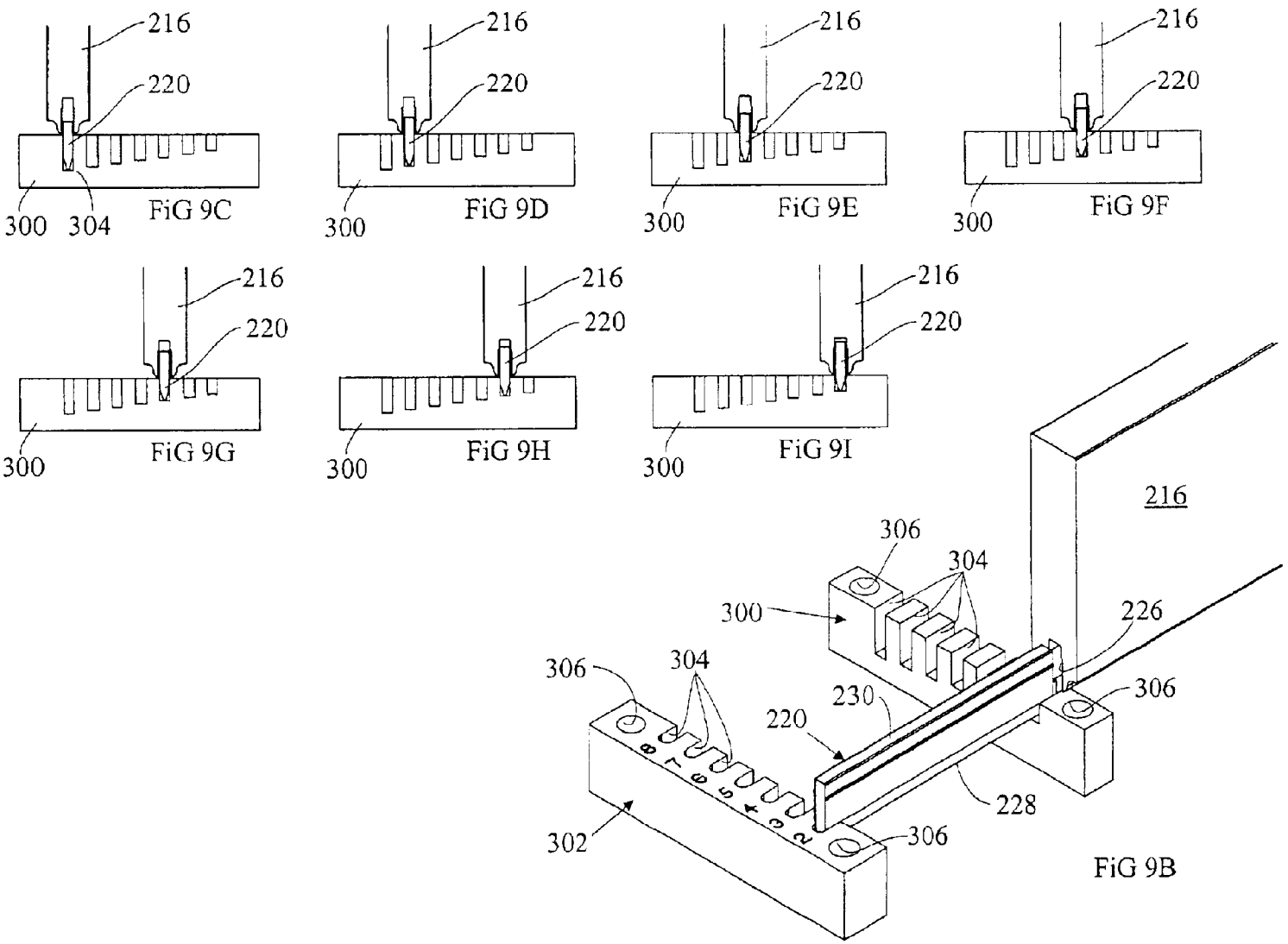
FIG. 9B is a perspective view of a fixture which may be used to install the light stop strip into the cross rail of FIG. 9A.
FIGS. 9C through 9I are end views of the fixture, light stop strip, and cross rail of FIG. 9B illustrating the position used for different depths of the light stop strip in the cross rail.

FIG. 9B shows a fixture 300 used to assist in installing the light stop strip 220 in the cross rail 216. The fixture 300 is an elongated, rectangular shape with a number of grooves 304 cut across the width dimension of the fixture 300 and holes 306 adjacent the ends of the fixture 300. The holes 306 may be used to secure the fixture 300 to a work surface (not shown) by means such as screws. A second fixture 302 is very similar to the first fixture 300 except that the grooves do not extend fully across the width dimension of the fixture 302, stopping short in order to provide a limit stop to the light stop strip 220. The grooves 304 vary in depth from a fairly shallow groove towards the first end of the fixtures 300, 302 and progressively deeper to a fairly deep groove towards the second end of the fixtures 300, 302. The depth of each groove corresponds to the distance the light stop strip 220 projects out of the cross rail 216. Thus, as shown in FIG. 9C, if the light stop strip 220 is placed inside the deepest groove 304, and the cross rail 216 is slid across the light stop strip 220 while resting on top of the fixture 300, such that the length-wise dimension of the light stop strip 220 fits inside the groove 226 on the cross rail 216, then the light stop strip 220 will be in its most extended position, corresponding to the barb 232 of the light stop strip 220 being in position "8" in FIG. 9A (FIG. 9A actually shows the light stop strip 220 in the most retracted position "1", that is, the barb 232 on the light stop strip 220 is in the position labeled "1"). FIGS. 9C through 9I diagrammatically depict the different positions of the light stop strip 220 in the fixture 300 to obtain the different depths of the light stop strip 220 in the cross rail 216. So, in this embodiment, the distance the light stop strip 220 projects is adjusted by removing and replacing the light stop strip 220 using a different position on the fixture.

Figure 8:
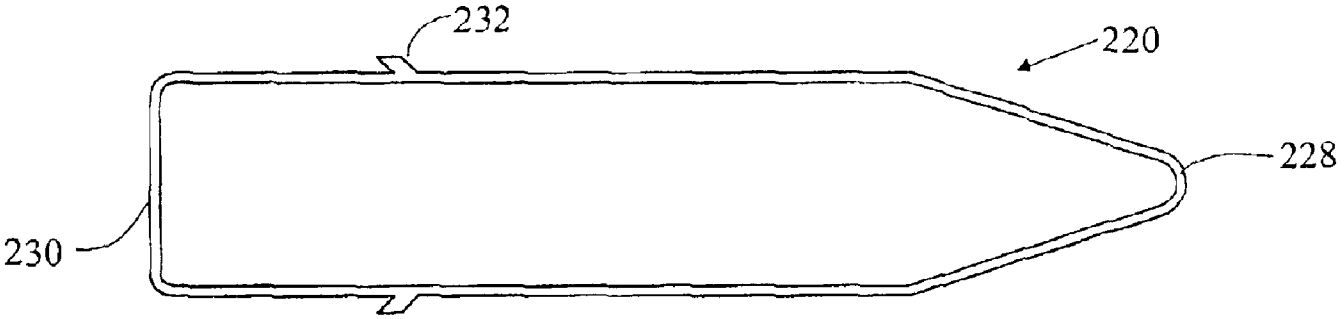
FIG. 8 is an enlarged sectional view of a third type of light stop strip that could be used in the shutter of FIG. 1.
Figure 10C:
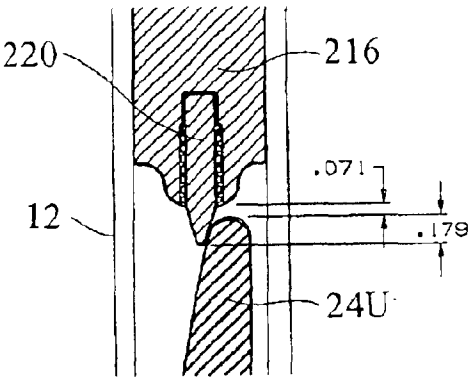
FIG. 10C is an enlarged, detailed view of the upper portion of the shutter of FIG. 10B.
Figure 10D:
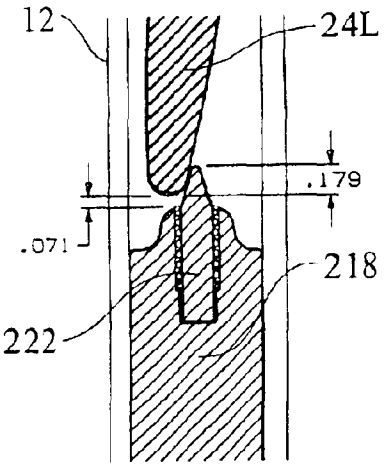
FIG. 10D is an enlarged, detailed view of the lower portion of the shutter of FIG. 10B.
Figure 10B:
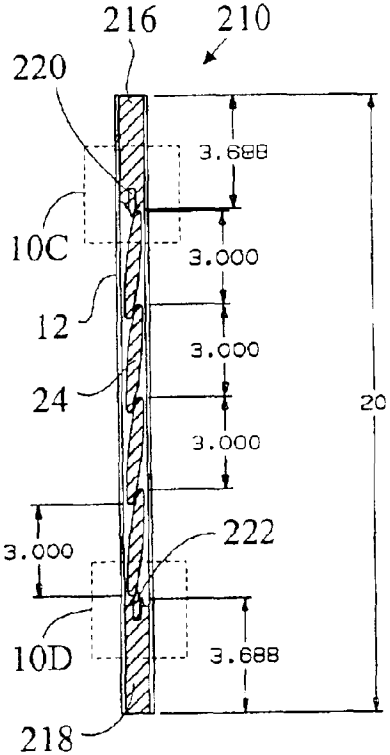
FIG. 10B is a view along the section 10B–10B of FIG. 10A.
Figure 10A:
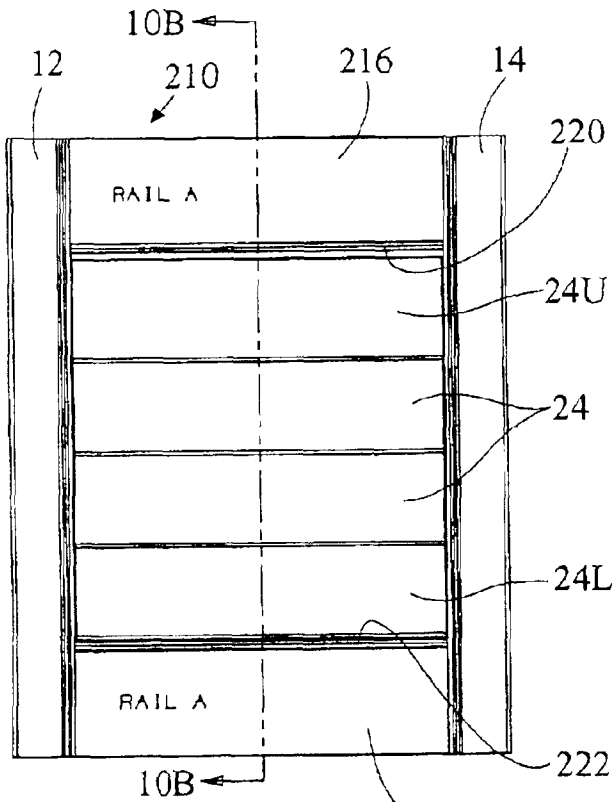
FIG. 10A is a front view of a shutter that is identical to the shutter of FIG. 1 except that it uses the light stop strip of FIGS. 8A–C.
Figure 11C:
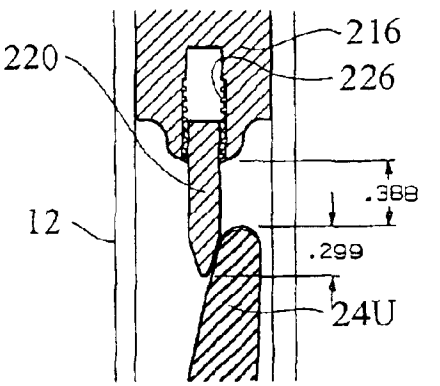
FIG. 11C is an enlarged, detailed view of the upper portion of FIG. 11B.
Figure 11D:
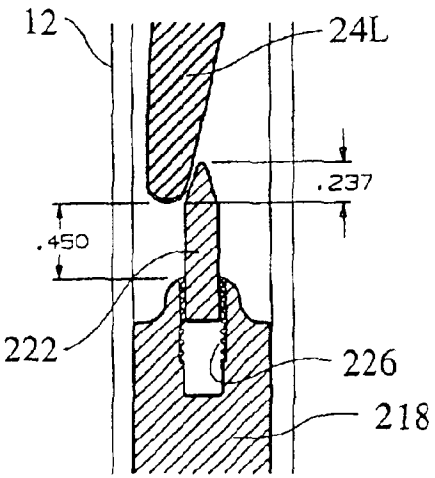
FIG. 11D is an enlarged, detailed view of the lower portion of FIG. 11B.
Figure 11B:
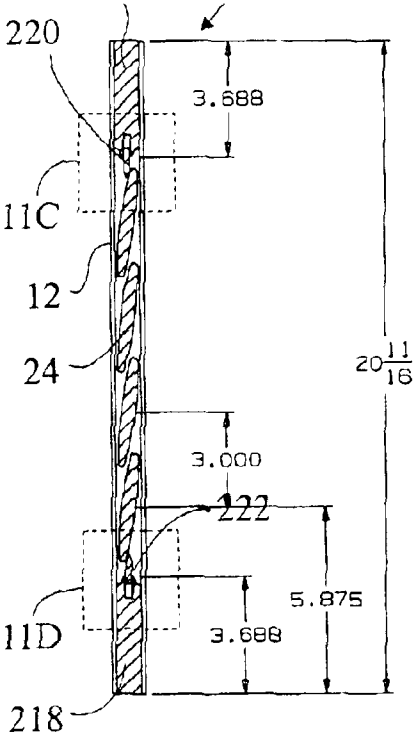
FIG. 11B is a view taken along section 11B—11B of FIG. 11A.
Figure 11A:
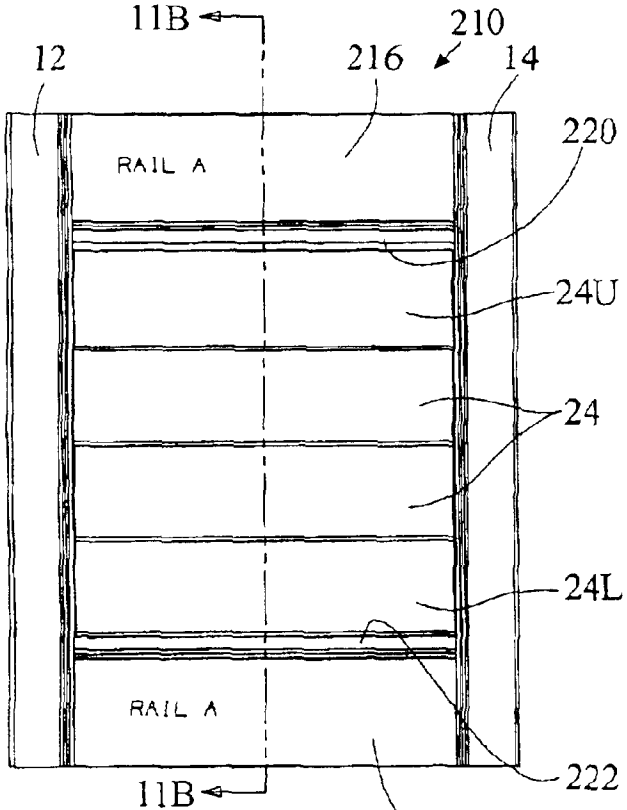
FIG. 11A is the same as FIG. 10A, but with the adjustable light stop strips extended to cover a slightly larger opening.
Figure 12C:
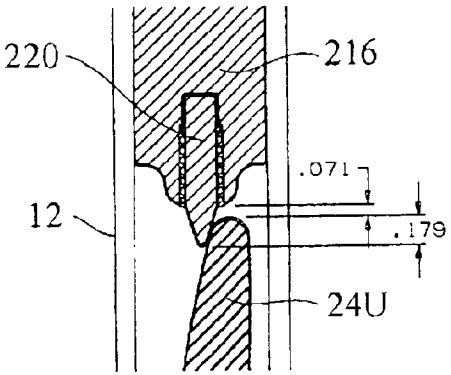
FIG. 12C is an enlarged, detailed view of the upper portion of FIG. 12B.
Figure 12D:
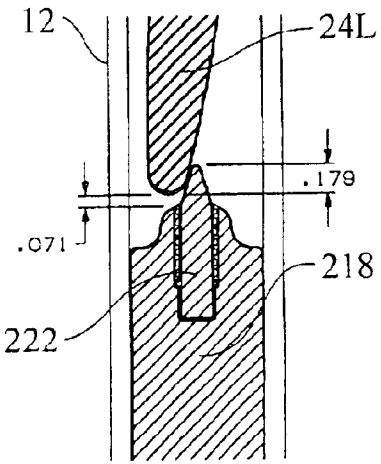
FIG. 12D is an enlarged, detailed view of the lower portion of FIG. 12B.
Figure 12B:
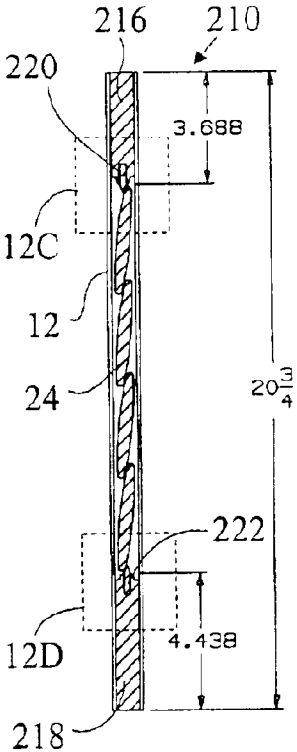
FIG. 12B is a view taken along section 12B—12B of FIG. 12A.
Figure 12A:
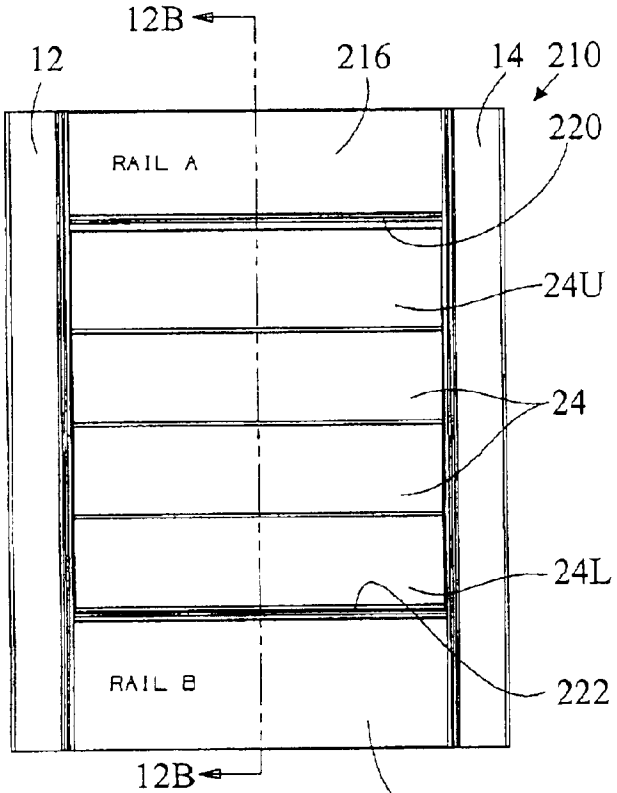
FIG. 12A is the same as FIG. 10A, but using a taller bottom rail to cover a larger opening.
Figure 13C:
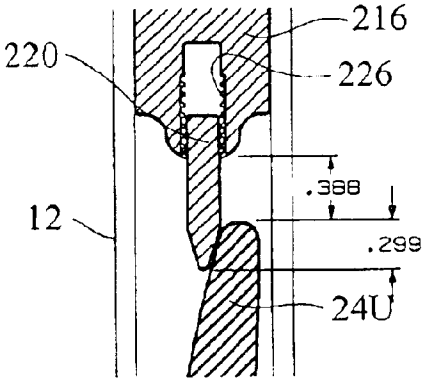
FIG. 13C is an enlarged, detailed view of the upper portion of FIG. 13B.
Figure 13D:
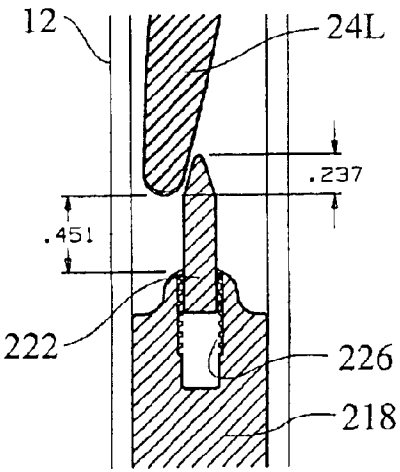
FIG. 13D is an enlarged, detailed view of the lower portion of FIG. 13B.
Figure 13B:
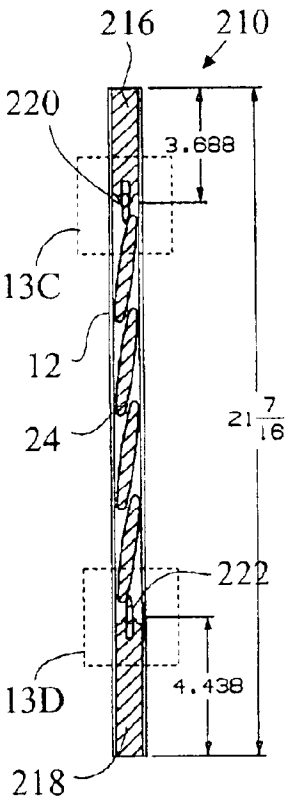
FIG. 13B is a view along section 13B—13B of FIG. 13A.
Figure 13A:
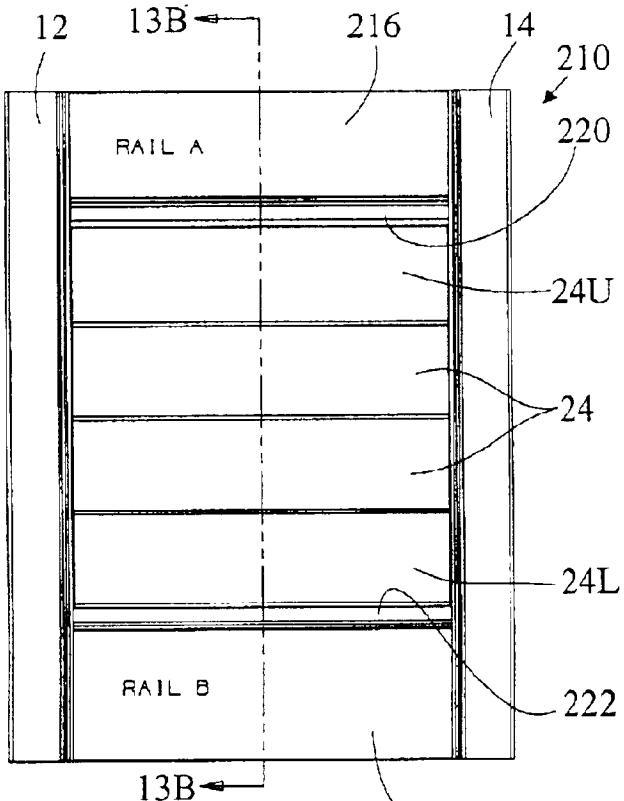
FIG. 13A is the same as FIG. 12A, but with the adjustable light stop strips extended to cover a larger opening.
Figure 14C:
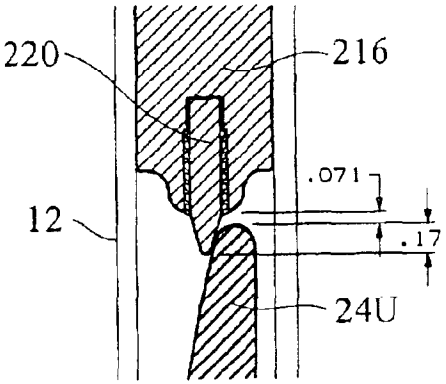
FIG. 14C is an enlarged, detailed view of the upper portion of FIG. 14B.
Figure 14D:
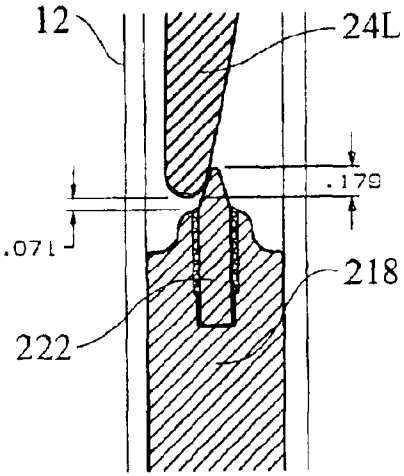
FIG. 14D is an enlarged, detailed view of the lower portion of FIG. 14B.
Figure 14B:
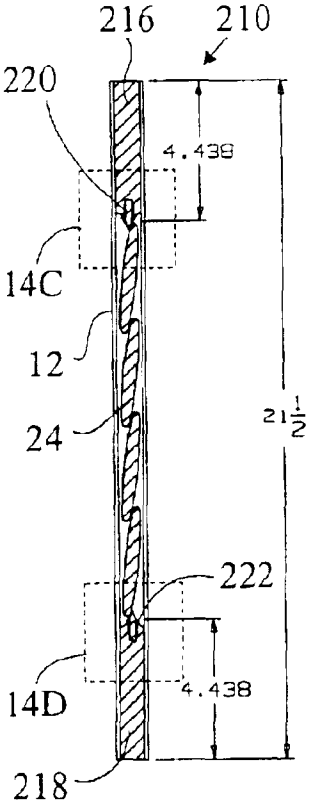
FIG. 14B is a view taken along section 14B—14B of FIG. 14A.
Figure 14A:
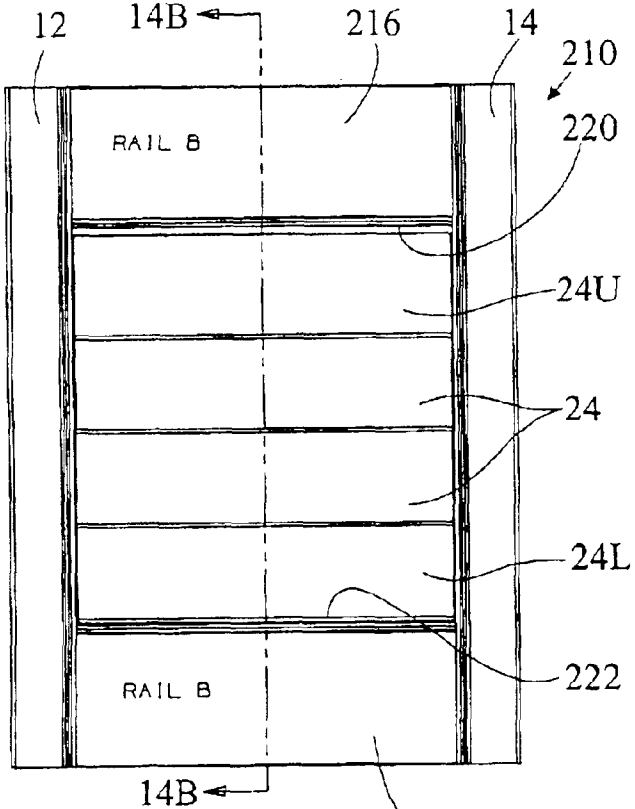
FIG. 14A is the same as FIG. 10A, but with taller top and bottom rails to cover a larger opening.
Figure 15C:
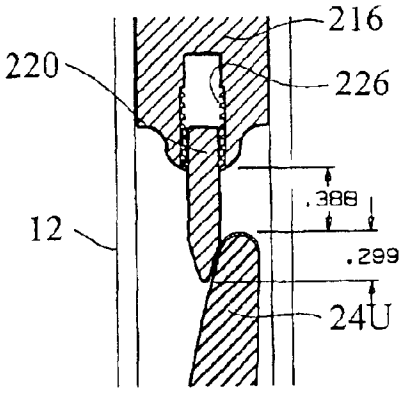
FIG. 15C is an enlarged, detailed view of the upper portion of FIG. 15B.
Figure 15D:
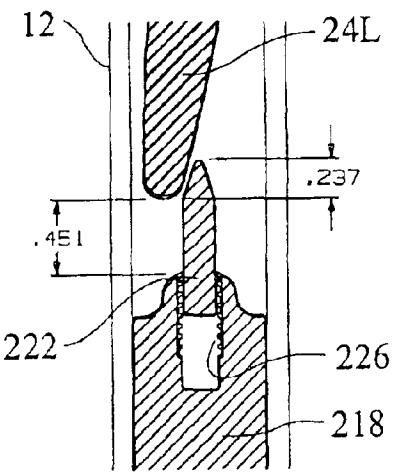
FIG. 15D is an enlarged, detailed view of the lower portion of FIG. 15B.
Figure 15B:
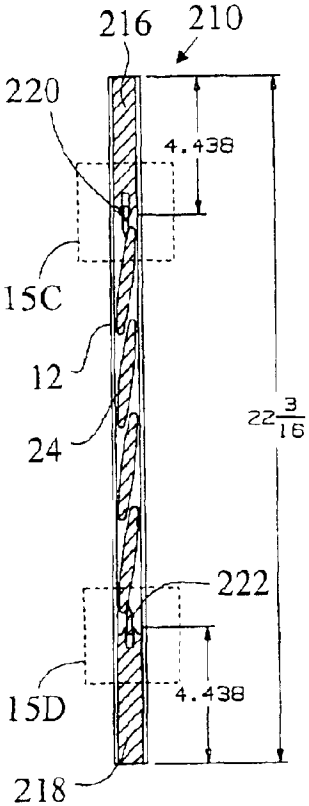
FIG. 15B is a view taken along section 15B—15B of FIG. 15A.
Figure 15A:
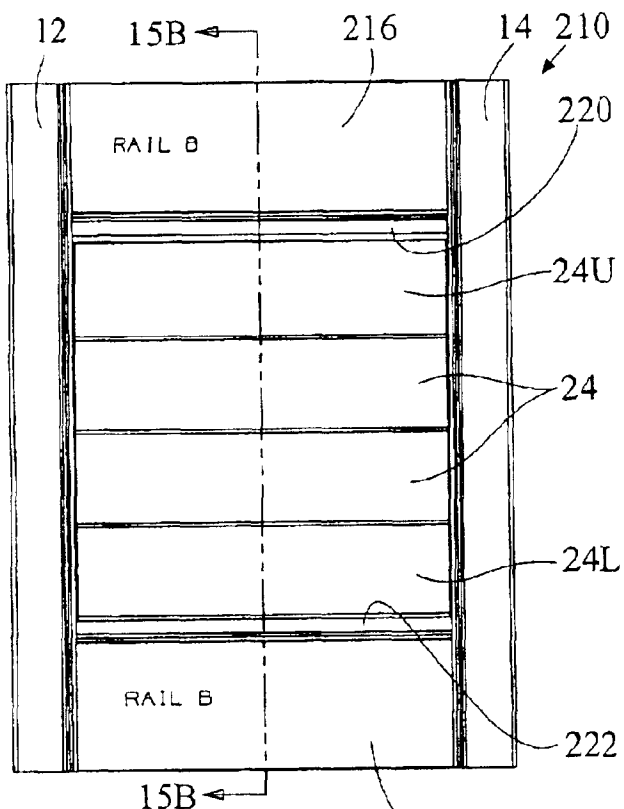
FIG. 15A is the same as FIG. 14A, but with the adjustable light stop strips extended.
Figure 16C:
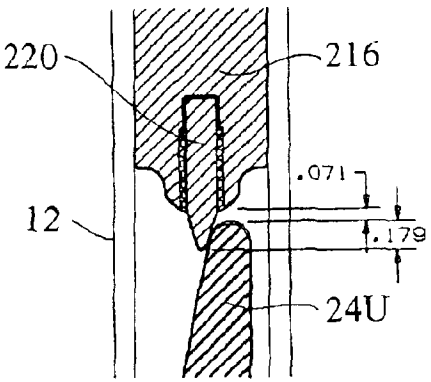
FIG. 16C is an enlarged, detailed view of the upper portion of FIG. 16B.
Figure 16D:
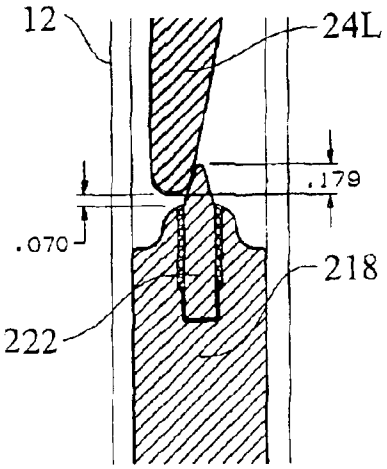
FIG. 16D is an enlarged, detailed view of the lower portion of FIG. 16B.
Figure 16B:
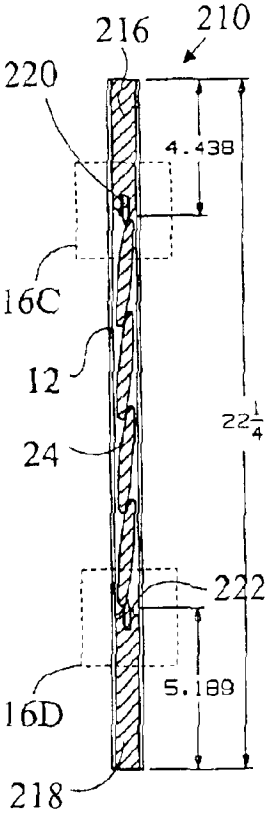
FIG. 16B is a view taken along section 16B—16B of FIG. 16A.
Figure 16A:
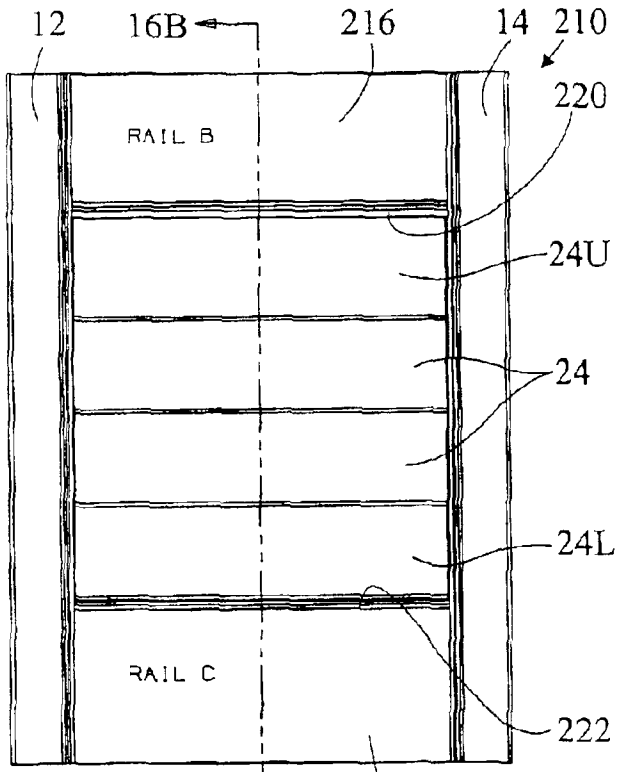
FIG. 16A is the same as FIG. 15A, but with a taller lower rail.
Figure 17C:
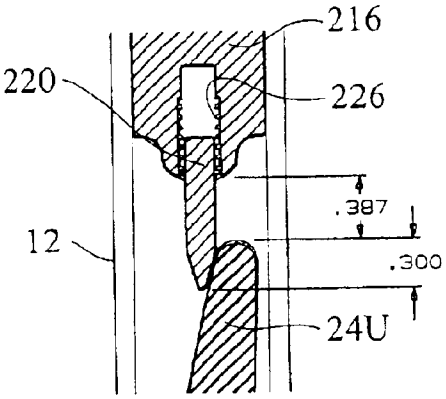
FIG. 17C is an enlarged, detailed view of the upper portion of FIG. 17B.
Figure 17D:
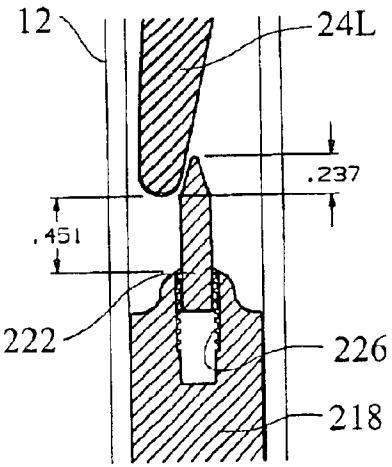
FIG. 17D is an enlarged, detailed view of the lower portion of FIG. 17B.
Figure 17B:
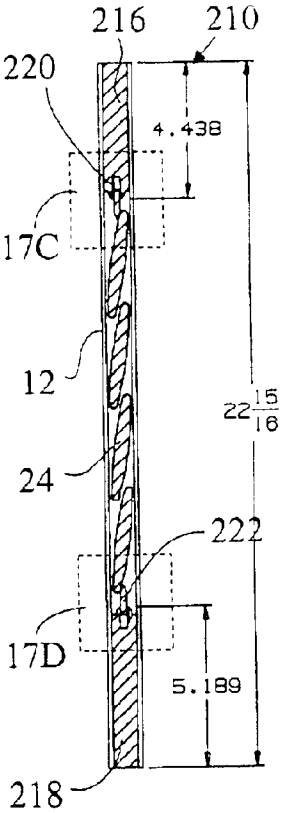
FIG. 17B is a view taken along section 17B—17B of FIG. 17A.
Figure 17A:
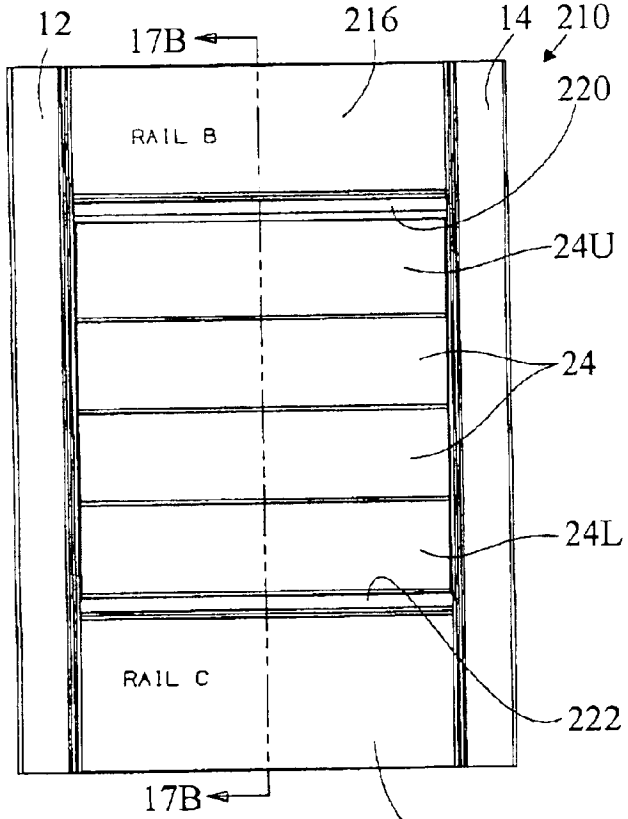
FIG. 17A is a the same as FIG. 16A, but with the light stop strips extended.

FIG. 10A shows a shutter that is identical to the shutter 10 of FIG. 1, except that it uses the light stop strip 220 of FIGS. 8 and 9. FIGS. 10A through 18D show the step-by-step process to provide varying heights of the shutter 210, taking advantage of the ability to extend and retract the light stop strips 220, 222, to adjust the distance between the outermost louvers 24U, 24L and their respective rails 216, 218, to use different sizes of rails 216, 218, and to add louvers 24. In this particular embodiment, three different heights of cross rails 216, 218 are made available to the assembler, and these are labeled Rail A, Rail B, and Rail C, with the rails becoming taller, proceeding from A to B to C. The incremental increase in rail height ensures that the height of the light stop strip, when it is fully extended, is still relatively small compared with the height of the cross rail, for aesthetic purposes. It would also be possible to use a single cross rail height in conjunction with a light stop strip having a larger range of extension positions, or to use a larger number of cross rail heights, as desired.

In FIGS. 10A–D, the shortest "A" rails are used for both the upper and lower cross rails 216, 218 in a shutter 210 having four louvers 24, and the light stop strips 220, 222 are retracted. The four louvers 24 are mounted on a "standard" three inch pitch. This shutter 210 spans an opening which is 20 inches tall. The vertical distance from the tip of the top louver 24U to its corresponding cross rail 216 is quite small, only 0.071 inches in this instance (See FIG. 10C)

In FIGS. 11A–11D the height dimension of the opening has increased to $20^{11}/_{16}$". The same "A" rails are still being used, but now the adjustable light stop strips 220, 222 are practically fully extended, and the vertical distance from the tip of the louver 24U to its corresponding cross rail 216 is quite large, 0.388 inches in this instance. (The same distance is also shown between the lowermost louver 24L and its corresponding cross rail 18.) It can be seen that any opening height between 20" and $20^{11}/_{16}$" can be handled simply by extending or retracting the upper and/or lower light stop strips 220, 222 and adjusting the vertical distance from the tip of the outermost louver or louvers to its (or their) respective cross rail (or rails) as needed.

In FIGS. 12A–12D, the height dimension of the opening has increased to 20¾". In this instance, the short lower cross rail 218 is replaced with a taller cross rail, labeled rail "B", and the light stop strips 220, 222 are in the retracted position. (The upper cross rail 216 could have been replaced instead, if desired). The increased height of the "B" rail 218 permits the light stop strips 220, 222 to be fully retracted and still have enough overlap with the louvers to ensure closure of the shutter 210. Once again, the vertical distance from the tip of the uppermost and lowermost louvers 24 to their corresponding cross rails is quite small, only 0.071 inches in this instance.

FIGS. 13A–13D illustrate the arrangement to fit an opening height dimension of 21 7/16". This arrangement is identical to the arrangement of FIGS. 12A–12D, except that the light stop strips 220, 222 have been moved to their extended positions, and the distances between the outermost louvers and their respective cross rails have been increased. For intermediate heights between that of FIGS. 12A–12D and that of this view, the light stop strips 220, 222 could be extended to some intermediate position, and the distances between the outermost louvers and their respective cross rails could also be adjusted to some intermediate position.

To span an incrementally taller opening, the process repeats itself, as illustrated in FIGS. 14A–14D. In this case, both the upper and lower cross rails 216, 218 are using the taller rail "B". This allows the shutter 210 to span the full 21½" opening with both light stop strips 220, 222 in the fully retracted position.

FIGS. 15A–15D show the same arrangement as FIGS. 14A–14D, but with the light stop strips 220, 222 fully extended and the spacing between the outermost louvers and their respective cross rails increased, so that the shutter covers an opening 22 3/16" tall. This new arrangement of two "B" rails carries the shutter 10 through another ¾" of opening height increase by simply managing the degree of retraction of the light stop strips 20, 22 relative to the cross rails 16, 18. Only when the opening height increases to 22¼" does one of the "B" cross rails need to be replaced by a "C" cross rail, as shown in FIGS. 16A–16D. Then, additional height can be obtained simply by managing the degree of retraction of the light stop strips 220, 222 relative to the cross rails 216, 218, and providing a corresponding adjustment of the distance from the louvers 24 to their respective cross rails 216, 218, until the light stop strips reach the fully extended positions and the distances between the louvers and the rails reach the desired maximum, as shown in FIGS. 17A–17D.

Finally, as shown in FIGS. 18A–18D, the opening height dimension increases to a full 23", which is a 3" increase from the initial dimension of 20" of FIGS. 10A–D. This is a sufficient increase in the height dimension to permit the addition of another louver 24, since the pitch of these louvers is 3 inches. (Of course, the dimensions shown here are for illustrative purposes only, and various sizes and pitches of rails and louvers could be used in accordance with the present invention.)

Figure 18C:
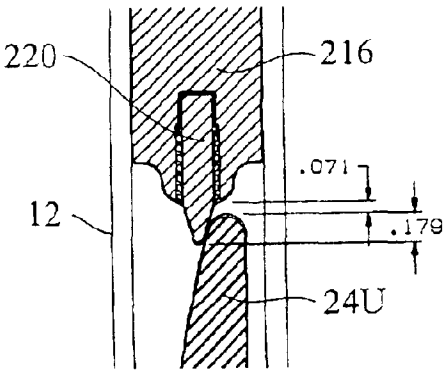
FIG. 18C is an enlarged, detailed view of the upper portion of FIG. 18B.
Figure 18D:
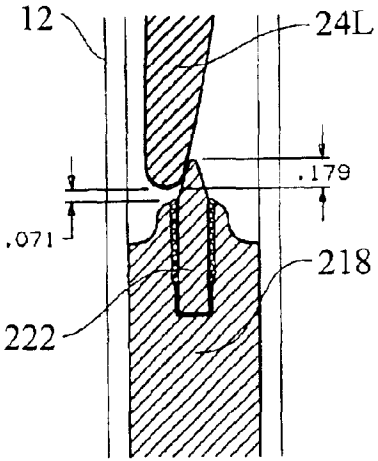
FIG. 18D is an enlarged, detailed view of the lower portion of FIG. 18B.
Figure 18B:
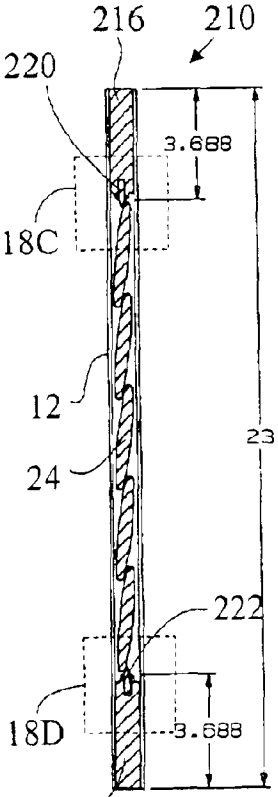
FIG. 18B is a view taken along section 18B–18B of FIG. 18A.
Figure 18A:
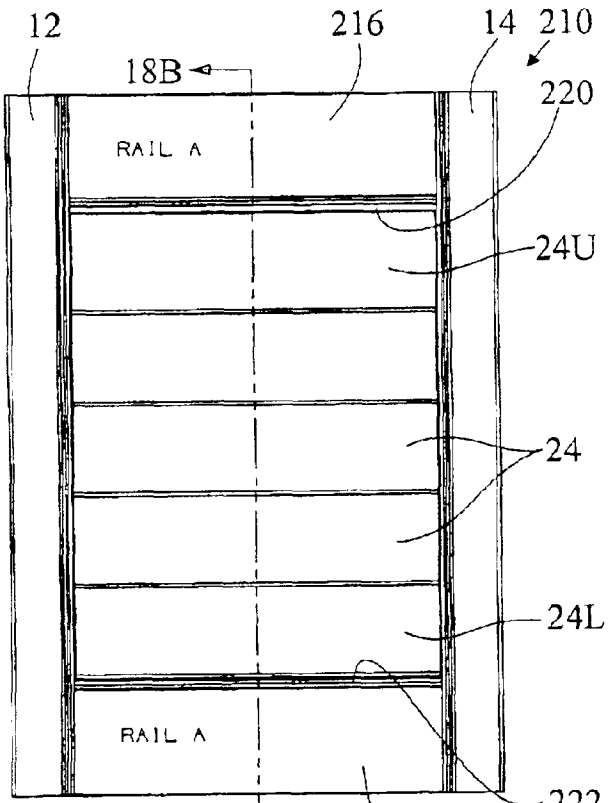
FIG. 18A is the same as FIG. 10A, but with another louver added.

FIG. 18A shows that an extra louver 24 has been added for a new total of five louvers 24. The shorter "A" size cross rails 216, 218 are used, the light stop strips 220, 222 are fully retracted, and the gaps between the outermost louvers and their respective cross rails are again at a minimum, so this shutter is identical to the shutter of FIGS. 10A–D, except that there is an additional louver 24. The entire process then can be repeated as the opening height dimension increases, or the entire process may be applied in reverse as the opening height dimension decreases. Thus, the assembler or fabricator can customize the height of the shutter 10 without damaging the pre-finished surfaces of the components.

FIGS. 23A–23D show a shutter 10', which is very similar to the shutter 10 of FIG. 1, except that it does not have adjustable light stop strips. In this embodiment, there is a single cross rail profile 16' with an extra tall, integral, non-adjustable light stop strip 20'. Whereas a typical fixed height light stop strip of the prior art is in the range of 3/16 inch to ⅜ inch tall, this extra tall light stop strip 20' is one-half inch tall or greater. The greater the height of the light stop strip, the greater can be the adjustment of the distance between the outermost louvers and their respective rails. If the height of the light stop strip 20' is approximately equal to half the height of the louvers 24, then the entire range of heights can be accommodated simply by adjusting the amount of overlap between the louvers and the light stop strips on the cross rails (which is also adjusting the distance between the outermost louvers and their respective cross rails), and by adding louvers. If the height of the light stop strip is substantially less than half the height of the louvers, then a number of sizes of cross rails 16', 18' may be provided as in the previous description to make up the difference in height until another louver can be added.

Notice that the light stop strip 20' in this embodiment is offset from the centerline of the cross rails 16', 18', with the upper light stop strip 20' offset to the rear of the front face 17', and the lower light stop strip 22' offset forward of the rear face 19'. This is distinguished from the prior light stop strips, which are centrally located and offset both from the front and rear faces of their respective cross rails. This offset of the light stop strip 20' allows for a taller light stop strip 20' while still allowing for good closure of the louvers 24 of the shutter 10. However, a non-adjustable light stop strip 20' may also be located on the centerline of its cross rail, and an adjustable light stop strip could also be offset from the centerline.

FIGS. 3, 4, 19, 20, 21, and 22 show a shutter 110, which uses mounting strips 40 to permit easy adjustment of the pitch or spacing between the louvers 24. Adjusting the pitch or spacing between the louvers 24 is another way to adjust the height of the shutter. The mounting strips 40, having holes 42 defining pivot points of the desired pitch or spacing, are attached to the inner surfaces of the stiles 112, 114. As with the first embodiment, the shutter 110 generally includes left and right vertical stiles 112, 114, upper and lower horizontal cross rails 116, 118 with upper and lower light stop strips 120, 122, and louvers 24, including an uppermost louver 24U and a lowermost louver 24L. The stiles 112, 114 and the cross rails 116, 118 form a substantially rectangular frame which defines an inner perimeter, within which are located the louvers 24. The light stop strips 120, 122 project vertically from the inner perimeter into the framed-in area. In this case, the light stop strips 120, 122 are fixed relative to their respective cross rails 116, 118, but it would also be possible to use adjustable light stop strips as described earlier.

Figure 19:
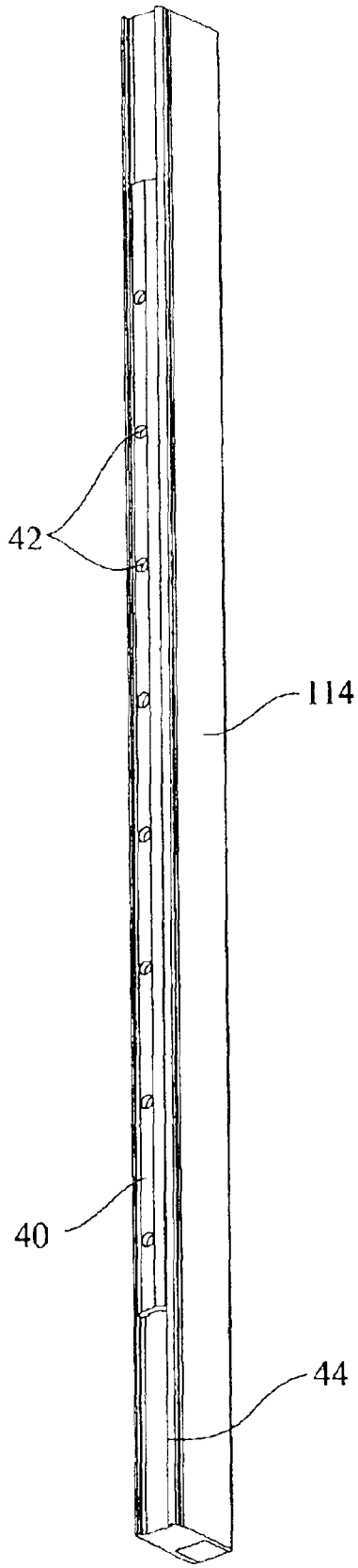
FIG. 19 is a perspective view of a stile and a mounting strip from FIG. 4.
Figure 20B:
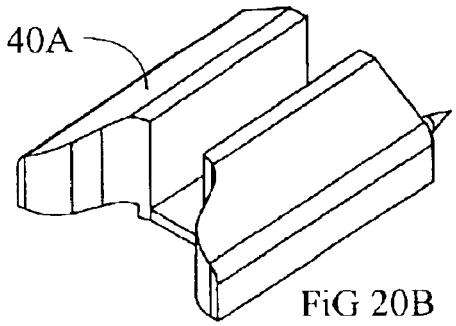
FIG. 20B is the same as FIG. 20A but taken from another direction.
Figure 20A:
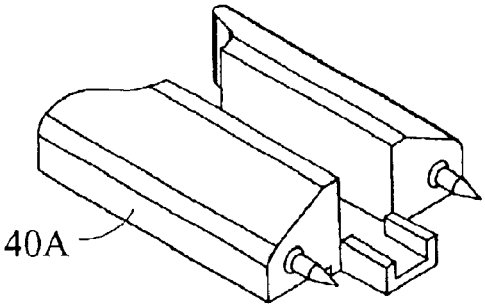
FIG. 20A is a perspective view showing the upper portion of one of the bridges of FIG. 4.
Figure 20C:
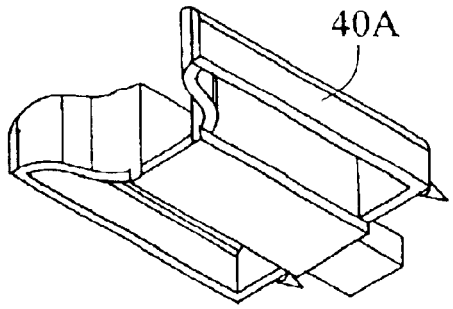
FIG. 20C is the same as FIG. 20B but shown from the back side.
Figure 20D:
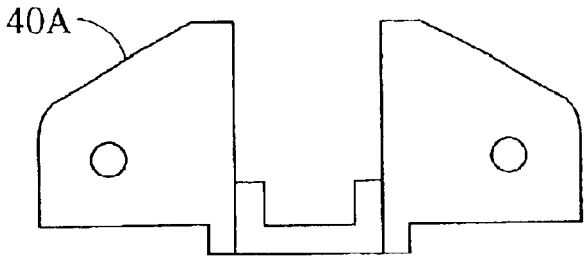
FIG. 20D is an end view of the bridge of FIG. 20A.
Figure 20:
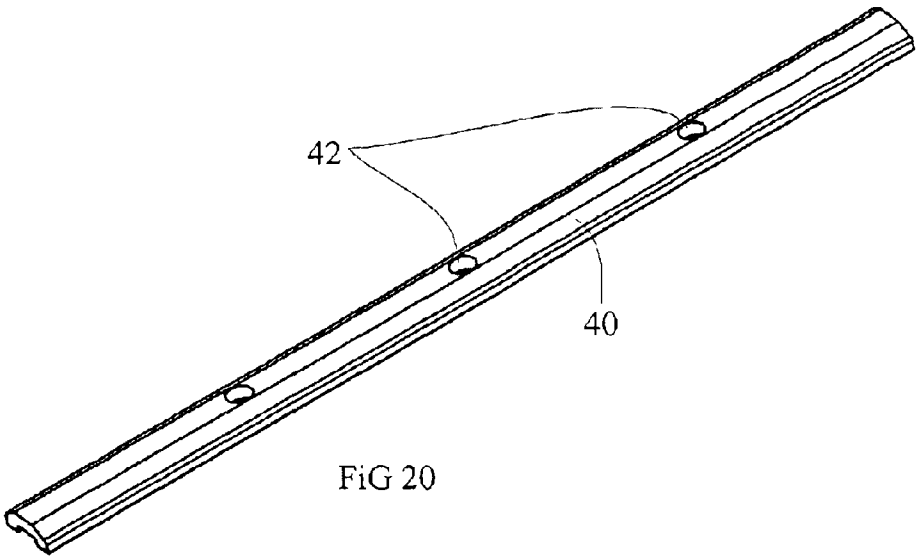
FIG. 20 is a perspective view of the mounting strip of FIG. 19.

As best shown in FIG. 19, the stile 114 defines a substantially rectangular cross-section channel 44 along its inner surface, and the mounting strip 40 is received in that channel 44, which prevents the mounting strip 40 from shifting to the front or rear relative to the stile 114. FIG. 20 is a perspective view of the mounting strip 40.

Figure 4:
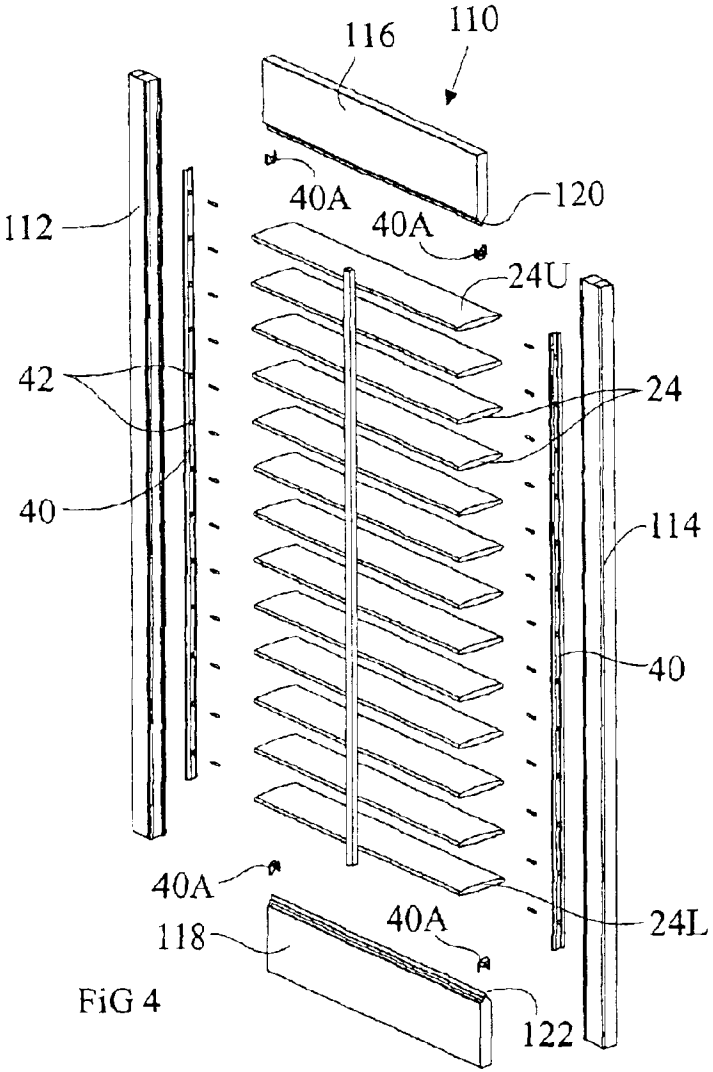
FIG. 4 is an exploded perspective view of the shutter of FIG. 3.
Figure 3:
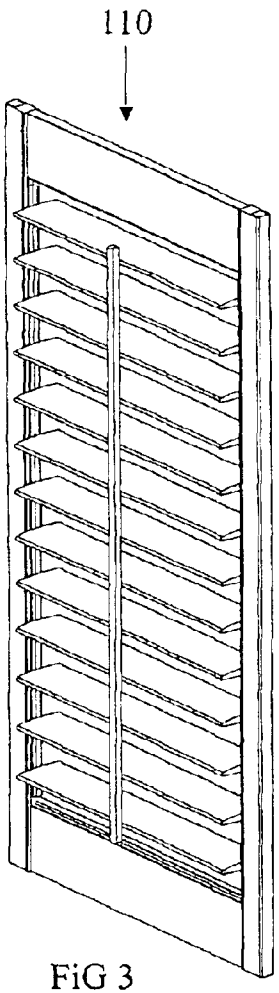
FIG. 3 is perspective view of a second embodiment of a shutter made in accordance with the present invention.
Figure 5B:
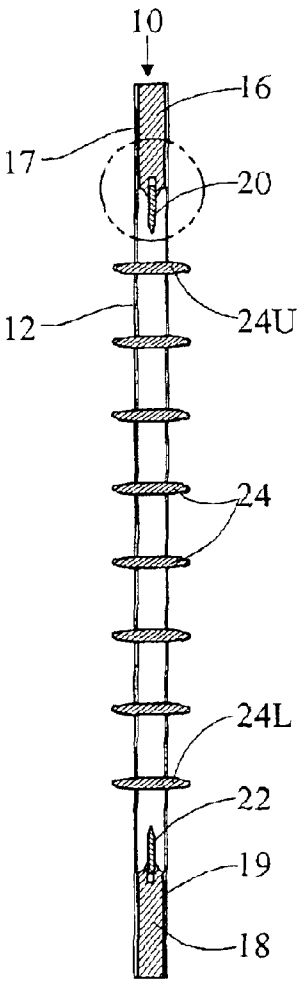
FIG. 5B is a view taken along the section 5B—5B of FIG. 5A.
Figure 5A:
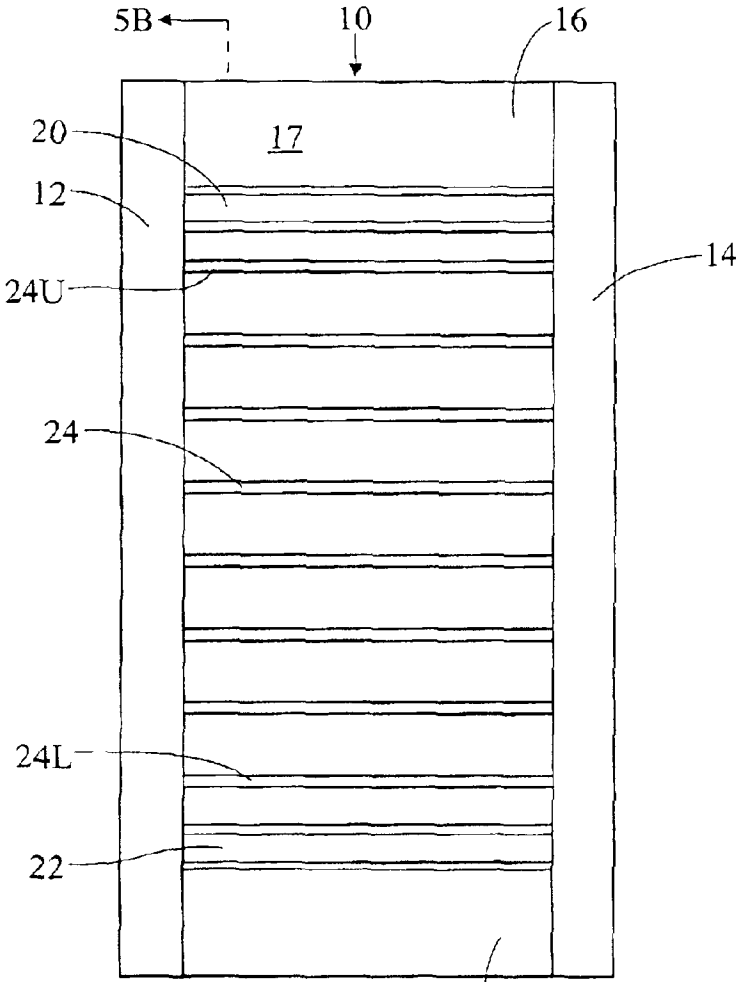
FIG. 5A is a front view of the shutter of FIG. 1, with the louvers in the open position.

FIGS. 20A–20D show a spacer or bridge 40A, which holds the mounting strip 40 a fixed distance above (or below) its respective cross rail 116, 118. The spacers or bridges 40A are shown in FIG. 4. These bridges 40A are wedged between their respective mounting strips 40 and their respective cross rails and include sharp projections which extend into the mounting strip 40.

FIG. 19 shows a single mounting strip 40 placed in the channel 44. However, two or more shorter strips 40 could be placed end-to-end in the channel 44, similar to a single mounting strip 40, but with each shorter strip 40 having its own pitch spacing of its pivot points.

Figure 21:
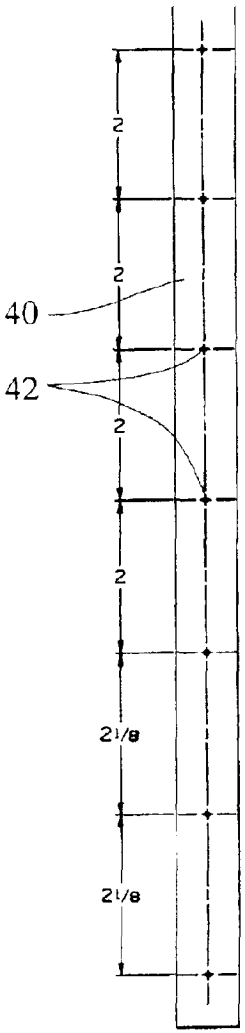
FIG. 21 is a front view of the mounting strip of FIG. 20, showing the mounting holes in an unbalanced spacing.

FIG. 21 shows a mounting strip 40 with holes 42 defining pivot points that are spaced at a first pitch spacing of two inches for most of its length, and with the lowermost holes 42 spaced apart a different, larger distance.

Figure 22:
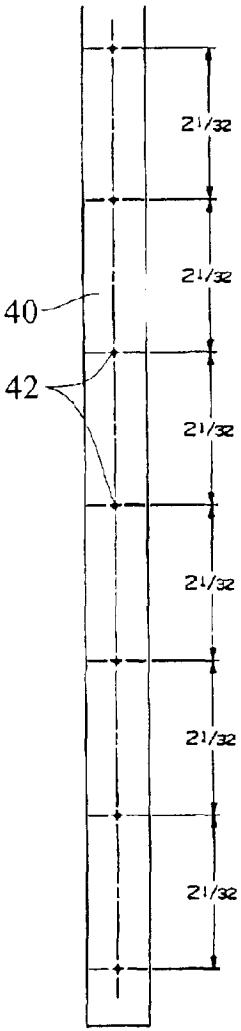
FIG. 22 is the same as FIG. 21, but showing the mounting holes in a balanced spacing.

FIG. 22 shows a mounting strip 40 with pivot points defined by holes 42 that are evenly spaced at the same pitch throughout the strip.

Figure 22A:
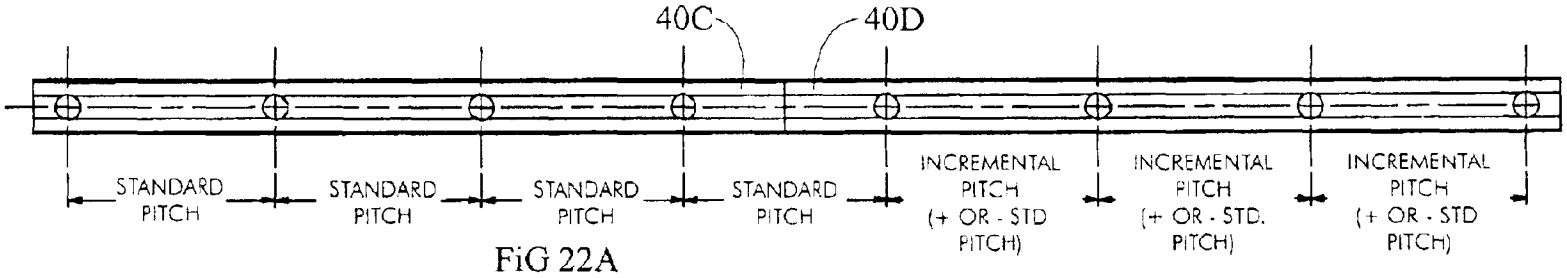
FIG. 22A is a view of two mounting strips at two different pitches, which are mounted end to end on a stile.

FIG. 22A shows two pieces of strip 40C, 40D that are abutted end to end, with the first strip 40C having a standard pitch spacing, and the second strip 40D having an alternative pitch spacing that is either larger than or smaller than the pitch spacing of the first strip 40C.

Figure 22B:
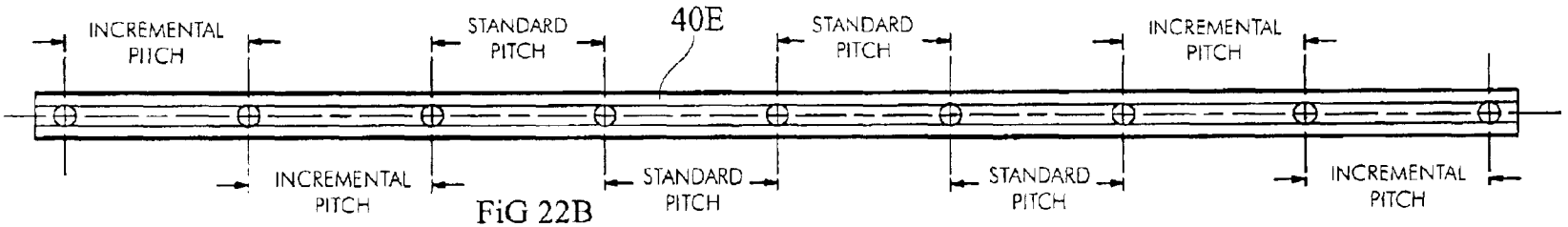
FIG. 22B is a view of a single mounting strip with a standard pitch in the central portion and different pitches at the ends.

FIG. 22B shows a single strip 40E that has standard pitch spacing in its central area, a second pitch spacing at one end, which is greater than the standard pitch, and a third pitch spacing at the other end, which is less than the standard pitch. These strips 40E may be manufactured a bit longer than most shutters, and then the desired portion may be cut off to select the desired combination of pitch spacings for a particular shutter that is being manufactured.

Figure 22C:
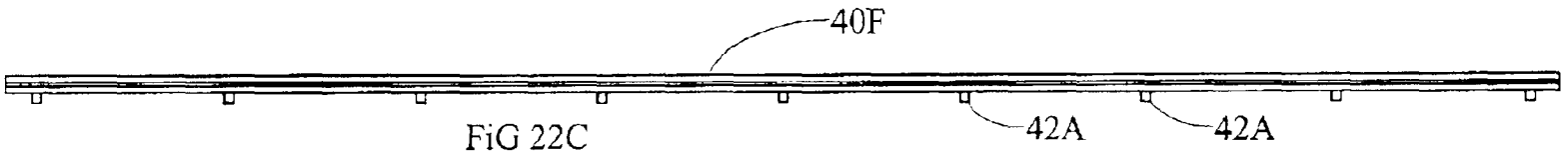
FIG. 22C is a side view of an alternative type of mounting strip, in which the pivot points are projections rather than holes or recesses.
Figure 22D:
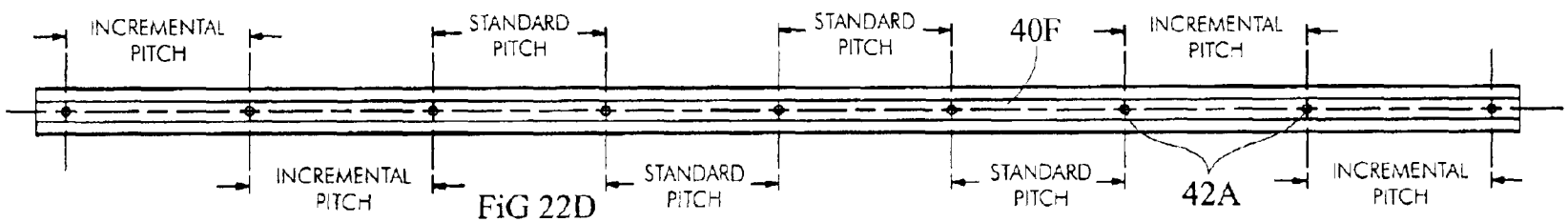
FIG. 22D is a front view of the mounting strip of FIG. 22C, showing standard pitch in the central portion and incremental pitch at the ends.
Figure 23C:
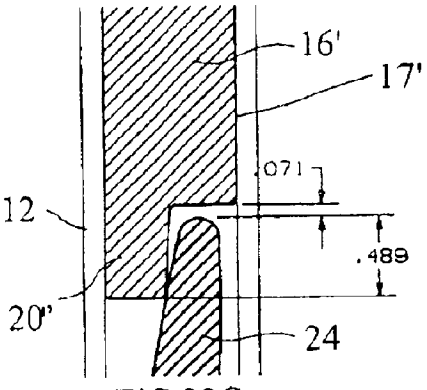
FIG. 23C is an enlarged, detailed view of the upper portion of FIG. 23B.
Figure 23D:
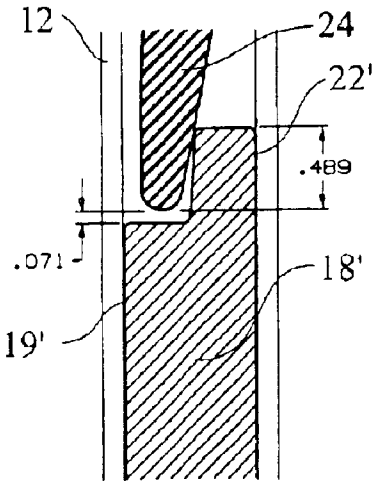
FIG. 23D is an enlarged, detailed view of the lower portion of FIG. 23B.
Figure 23B:
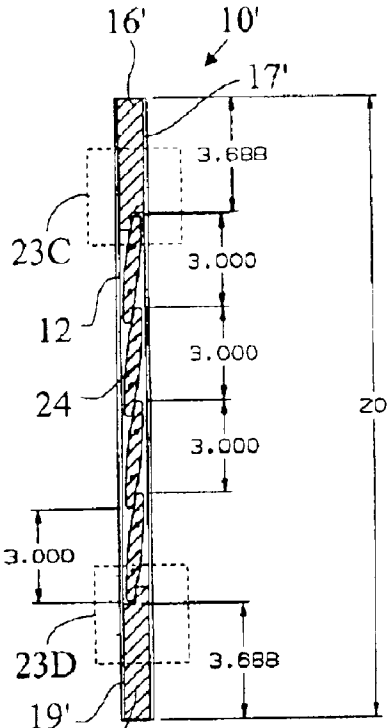
FIG. 23B is a view taken along section 23B—23B of FIG. 23A.
Figure 23A:
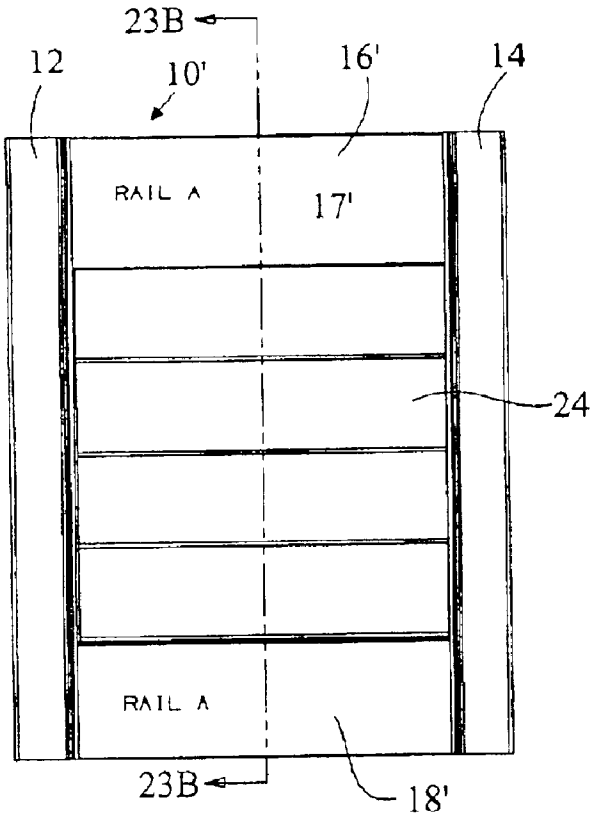
FIG. 23A is a front view of another embodiment of a shutter made in accordance with the present invention.

FIGS. 22C and 22D show an alternative strip 40F, which, instead of using holes to define pivot points, uses projections 42A. In that case, the louvers would have corresponding holes or recesses. Alternatively, the strip 40 could be supplied without predrilled holes 42, which would permit the fabricator to drill holes to the particular pitch spacing(s) needed for the application, using a simple template. Similarly, a variety of pitch spacings could be drilled into the stiles 12, 14 of the embodiment of FIGS. 1 and 2, which does not use mounting strips.

FIG. 22 shows a mounting strip 40 with holes 42 evenly-spaced every 2 1/32". If the "standard" pitch for a shutter 110 is 2 inches, and the framed-in area of the shutter 110 is desired to be 32 inches tall, then the shutter 110 will have a total of 16 louvers 24 (16 louvers at a standard 2 inch pitch yield a framed-in area which is 32 inches tall). Should the framed-in area need to be ½inch taller, then by adding 1/32" to the pitch of each louver, the shutter 110 would "grow" the needed ½" (1/32×16). (Of course, the stiles 112, 114 would also have to be cut taller. Thus, a mounting strip 40 drilled to the "standard" two inch pitch could be entirely replaced by a new mounting strip 40 drilled to a 2 1/32 inch pitch (as shown in FIG. 22), with the result being a "balanced" pitch along the entire length of the shutter 110.

Another approach to the example discussed above would be to increase the pitch of the bottom four louvers 24 (or the top four louvers, or any other desired group of louvers) from the standard 2 inch pitch to a new 2⅛ inch pitch, leaving the rest of the louvers 24 in the shutter 110 at the standard 2 inch pitch. The end result is that the shutter 110 "grows" the needed ½" (⅛"×4). An easy way to accomplish this task is to use a first mounting strip 40 which has been pre-drilled to the "standard" two inch pitch for all but the last four louvers 24, and use a second mounting strip 40 pre-drilled to the 2⅛ inch pitch for the bottom four louvers. The two mounting strips preferably would abut each other end-to-end, and the resulting strip would have two different pitches, or an "unbalanced pitch", as shown in FIG. 21. From an aesthetic point of view, it is preferred not to make the pitch of the "unbalanced" louvers more than ⅛" greater than the pitch of the rest of the louvers. Technically, the increment can be as large as required as long as adjacent louvers 24 still have enough overlap to close against each other when the shutter 110 is tilted closed.

Given sufficient louvers 24 in a shutter 110 and sufficient incremental increase in the pitch, it is possible to "grow" or "shrink" the shutter 110 at least to the point where a louver 24 may be added or deleted, at which point one goes back to the "standard" pitch, and the process can be repeated until the right size shutter is reached for the opening to be covered. For example, if a shutter 110 has a total of 24 louvers on a 3 inch pitch, increasing the pitch by ⅛" on all 24 louvers provides a total "growth"of the shutter of 3 inches (24×⅛). Thus, to "grow" up to the 3 inches, one simply changes the pitch on the mounting strips as required. To grow beyond the 3 inches, one adds louvers (at the standard 3 inch pitch) until the amount needed to grow is less than 3 inches, and then one reverts to changing the pitch on the mounting strips as required.

However, if there are insufficient louvers in the shutter 110, it may be preferred to use a combination of varying the pitch along with varying the rail heights or along with adjusting the light stop strips, or one may decide to use all three methods together.

FIGS. 24–33 show alternative mechanisms for biasing the mounting strips inwardly towards the louvers in order to maintain a snug fit between the louvers and their mounting strips.

Figure 24:
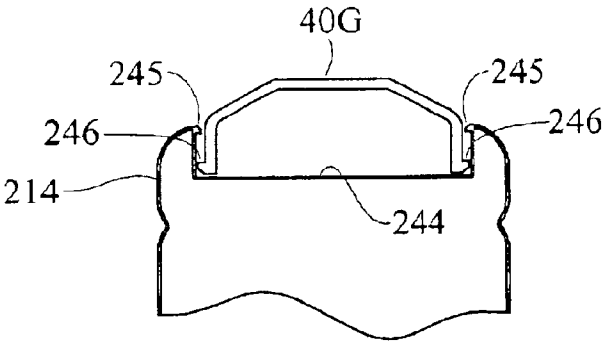
FIG. 24 is an end view of an alternative type of stile and a first type of resilient mounting strip.

In FIG. 24, the mounting strip 40G is made of a relatively thin, resilient material, such as polypropylene. The strip 40G has a crowned, substantially U-shaped cross section and ends in outwardly-projecting barbs 246. The stile 214 also defines barbs 245, which permits the strip 40G to snap into the stile 214. This strip 40G would be sized so that, when the shutter is assembled, the crown of the strip 40G would be compressed. The resilience of the strip 40G would then create a spring force, biasing the strip 40G inwardly, toward the louvers 24.

Figure 25:
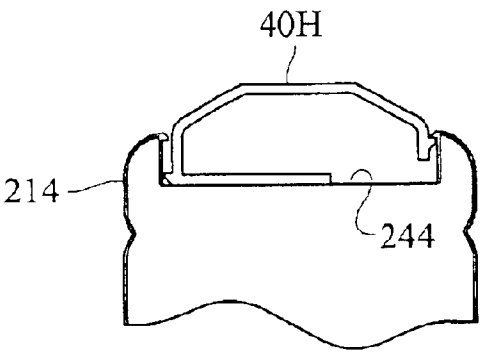
FIG. 25 is an end view of the stile of FIG. 24 and another type of resilient mounting strip.

FIG. 25 uses a mounting strip 40H, which also is made of a resilient material such as plastic and has a crowned shape. Again, this mounting strip 40G would be compressed so that it provides a biasing force pushing it inwardly, toward the louver.

Figure 26:
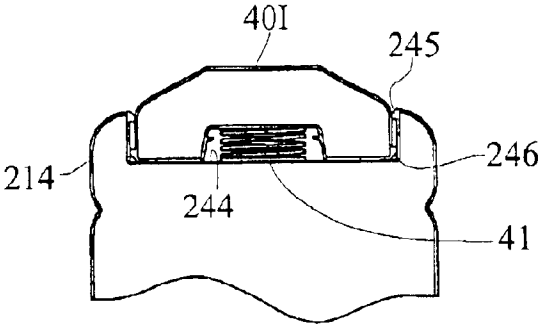
FIG. 26 is an end view of the stile of FIG. 24 with another type of mounting strip biased by a spring.

FIG. 26 shows another mounting strip 40I, which itself is not resilient. In this embodiment, several coil springs 41 are placed at intervals along the strip and provide a biasing force between the stile 214 and the mounting strip 40I.

Figure 28:
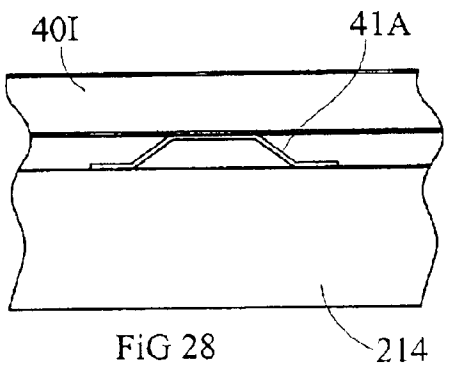
FIG. 28 is a section view through the stile and mounting strip of FIG. 27.
Figure 27:
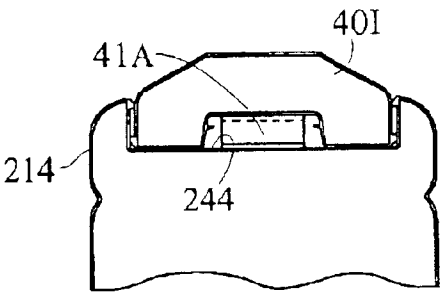
FIG. 27 is a broken away end view of the stile and mounting strip of FIG. 26 but using another type of spring.

FIGS. 27 and 28 show an embodiment that is very similar to that of FIG. 26, except that leaf springs 41A are used in place of coil springs.

Figure 29:
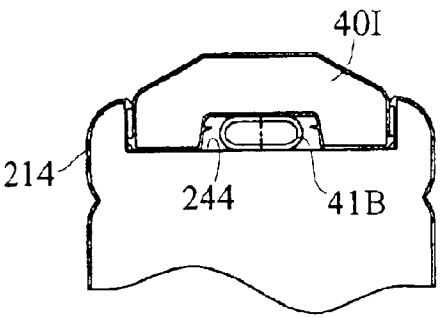
FIG. 29 is an end view of the same mounting strip and stile as FIG. 26 but using another type of biasing mechanism.
Figure 33:
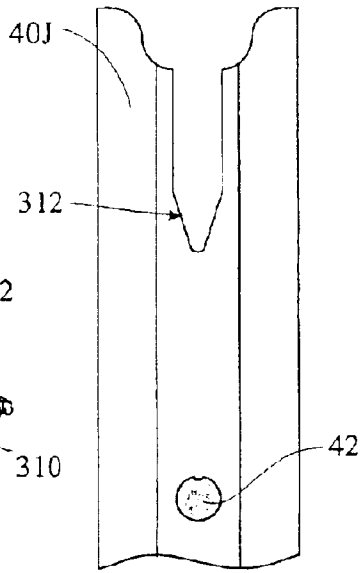

FIG. 29 shows an embodiment very similar to that of FIG. 26, except that a compressible, resilient strip of rubber or flexible plastic is placed between the mounting strip 401 and the stile 214 to provide the biasing force.

Figure 32:
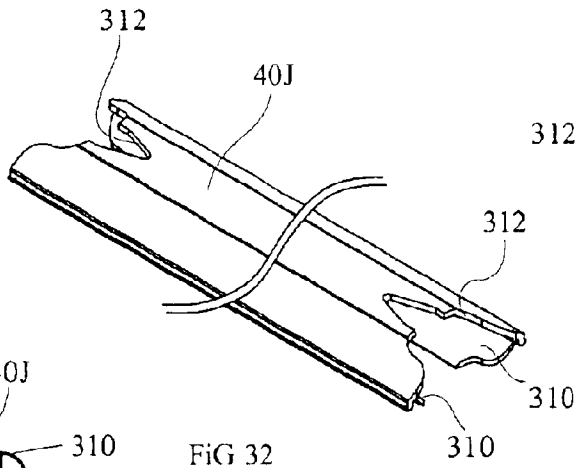
FIG. 32 is a perspective view of the resilient mounting strip of FIG. 30 without the holes used for mounting the louvers to the strip; and, FIG. 33 is a broken away, plan view of the resilient mounting strip of FIG. 32.
Figure 31:
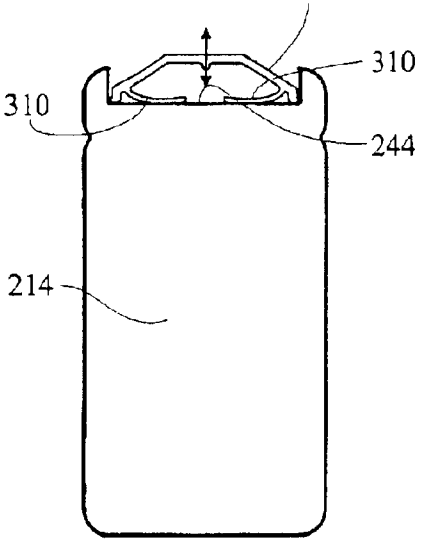
FIG. 31 is the same view as in FIG. 30 but with the mounting strip shown in its compressed state as when the louvers are being installed or removed.
Figure 30:
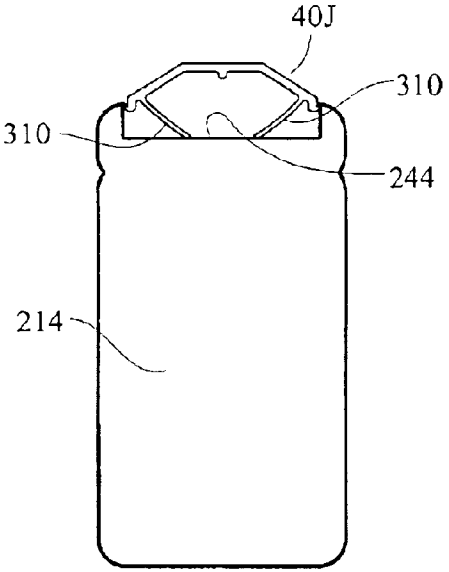
FIG. 30 is an end view of the stile of FIG. 24 and another type of resilient mounting strip when the mounting strip is in its uncompressed state.

FIG. 30 shows another mounting strip 40J, which itself is not resilient. In this embodiment, the mounting strip 40J includes two flexible legs extending from the inside surface of the mounting strip 40J and projecting toward the substantially rectangular cross-section channel 244 of the stile 214. The flexible legs 310 normally push against the channel 244, biasing the mounting strip 40J inwardly, toward the louvers 24. However, the mounting strip 40J may be pushed toward the stile 214 by flexing the legs 310 (as shown in FIG. 31), creating the clearance necessary to install or to remove the louvers 24, FIG. 32 is a perspective view of the mounting strip 40J of FIGS. 30 and 31. This mounting strip 40J is normally cut to the required length to fit between the cross rails and, instead of using the bridge 40A shown in FIGS. 20A–20D, the ends 312 are routed to provide a contoured fit with the rails used.

Such biasing mechanisms as described above may be used on one side of the shutter, or on both sides, or there may be no biasing at all, as desired.

The embodiments described above are simply intended to show examples of preferred shutters made in accordance with the present invention. It will be obvious to those skilled in the art that many modifications may be made to the embodiments described above without departing from the scope of the present invention.

What is claimed is:

1. A shutter for covering an architectural opening, comprising:

a substantially rectangular frame defining an inner perimeter, said frame including left and right vertical stiles and upper and lower horizontal cross rails; at least one of said cross rails defining a groove along its inner perimeter; and a light stop strip received in said groove and projecting inwardly a desired distance from said inner perimeter, said light stop strip having an outer mating surface, and said groove having an inner mating surface which receives said outer mating surface, and including means for adjusting the position of said light stop strip relative to said groove to permit adjustment of said desired distance.

2. A shutter for covering an architectural opening as recited in claim 1, wherein at least one of said inner and outer mating surfaces defines teeth.

3. A shutter for covering an architectural opening as recited in claim 1, wherein both of said mating surfaces define teeth.

4. A shutter for covering an architectural opening as recited in claim 1, and further comprising a shim lying in said groove adjacent to said light stop strip to prevent said light stop strip from being pushed further into said groove.

5. A shutter for covering an architectural opening, comprising:

a substantially rectangular frame defining an inner surface, said frame including left and right vertical stiles and upper and lower horizontal cross rails;

a plurality of horizontally-oriented louvers, including one topmost louver; and a first plurality of pivot points defined on said stiles, said first plurality of pivot points being spaced apart at a first pitch spacing, and at least one additional pivot point defined on each of said stiles, said additional pivot point being spaced apart from the next adjacent pivot point at a second pitch spacing, which is different from said first pitch spacing.

6. A shutter for covering an architectural opening as recited in claim 5, and further comprising mounting strips mounted on the inner surfaces of said stiles, wherein said mounting strips define the pivot points.

7. A shutter for covering an architectural opening as recited in claim 6, wherein said louver mounting strips include projections which define said pivot points, and said louvers include corresponding holes which mate with said projections.

8. A shutter for covering an architectural opening as recited in claim 6, wherein said louver mounting strips define holes which define said pivot points, and said louvers include projections which mate with said holes.

9. A shutter for covering an architectural opening as recited in claim 6, wherein at least upper and lower mounting strips are mounted on each of said stiles, said upper mounting strips defining said first pitch spacing and said lower mounting strips defining said second pitch spacing.

10. A shutter for covering an architectural opening as recited in claim 6, wherein each of said stiles includes at least one mounting strip which defines at least two different pitch spacings.

11. A shutter for covering an architectural opening as recited in claim 5, wherein said substantially rectangular frame defines an inner perimeter, at least one of said cross rails defines a groove along its inner perimeter, and further comprising a light stop strip received in said groove and projecting inwardly a desired distance from said inner perimeter, said light stop strip having an outer mating surface, and said groove having an inner mating surface which receives said outer mating surface, and comprising means to permit adjustment of the relative vertical positions of said light stop strip and said groove.

12. A shutter for covering an architectural opening, comprising:

a substantially rectangular frame defining an inner surface, said frame including left and right vertical stiles and upper and lower horizontal cross rails;

left and right mounting strips mounted on said left and right vertical stiles, said mounting strips defining a plurality of pivot points;

a plurality of horizontally-oriented louvers mounted on said frame at said pivot points;

means for biasing at least one of said mounting strips inwardly and for allowing said biased mounting strip to be moved outwardly against said biasing means a sufficient distance to permit said louvers to be mounted on and removed from said frame while said mounting strips remain mounted on their respective vertical stiles, and means for retaining said biased mounting strip on said frame so as to prevent it from separating from said frame upon the removal of said louvers.

13. A shutter for covering an architectural opening as recited in claim 12, and further comprising at least one spring, mounted between one of said vertical stiles and its respective mounting strip to provide said inward bias.

14. A shutter for covering an architectural opening as recited in claim 12, wherein at least one of said mounting strips has a U-shaped cross section and is compressed to provide said inward bias.

15. A shutter for covering architectural openings as recited in claim 12, and further comprising a resilient, compressed strip lying between at least one of said vertical stiles and its respective mounting strip to provide said inward bias.

16. A shutter for covering architectural openings as recited in claim 12, wherein said inwardly biased mounting strip further comprises at least one flexible member integral to said mounting strip, wherein said flexible member biases said mounting strip inwardly.

17. A shutter for covering architectural openings, comprising:

left and right vertical stiles and upper and lower horizontal cross rails connected together to form a substantially rectangular frame defining an inner surface;

left and right mounting strips mounted on said left and right vertical stiles, said mounting strips defining a plurality of pivot points having a first pitch spacing and at least one pair of pivot points having a second pitch spacing from the next adjacent pivot points;

means for inwardly biasing at least one of said mounting strips;

a plurality of horizontally-oriented louvers pivotably mounted on said frame at said pivot points; and upper and lower light stop strips mounted on said upper and lower horizontal cross rails, respectively, including means for adjusting the distances the light stop strips project inwardly from their respective cross rails.

18. A shutter for covering an architectural opening, comprising:

a substantially rectangular frame defining an inner surface, said frame including left and right vertical stiles and upper and lower horizontal cross rails;

left and right mounting strips mounted on said left and right vertical stiles, said mounting strips defining a plurality of pivot points, wherein at least one of said mounting strips is inwardly biased;

at least one spring, mounted between one of said vertical stiles and its respective mounting strip to provide said inward bias;

a plurality of horizontally-oriented louvers mounted on said frame at said pivot points; and retaining means for preventing the biased mounting strip from separating from its respective stile upon removal of said louvers.

19. A shutter for covering an architectural opening, comprising:

a substantially rectangular frame defining an inner surface, said frame including left and right vertical stiles and upper and lower horizontal cross rails;

left and right mounting strips mounted on said left and right vertical stiles, said mounting strips defining a plurality of pivot points, wherein at least one of said mounting strips is inwardly biased;

a resilient, compressed strip lying between at least one of said vertical stiles and its respective mounting strip to provide said inward bias;

a plurality of horizontally-oriented louvers mounted on said frame at said pivot points; and retaining means for preventing said biased mounting strip from separating from its respective stile upon removal of said louvers.

20. A shutter for covering an architectural opening, comprising:

a substantially rectangular frame defining an inner surface, said frame including left and right vertical stiles and upper and lower horizontal cross rails;

left and right mounting strips mounted on said left and right vertical stiles, said mounting strips defining a plurality of pivot points, wherein at least one of said mounting strips has a substantially U-shaped cross-section and includes an additional leg, integral with and resiliently projecting from said U-shaped cross-section, which biases said mounting strip inwardly; and a plurality of horizontally-oriented louvers mounted on said frame at said pivot points.

* * * * *